US006145782A

United States Patent [19]

King et al.

[11] Patent Number: 6,145,782

[45] Date of Patent: Nov. 14, 2000

[54] SHEET MATERIAL DISPENSER

[75] Inventors: Timothy James King, Clwyd; James Justin Beech, Chester; Neville John Pryke; Richard Stephen Thom, both of London; Peter John Harvey Bessey, East Sheen; Stephen Patrick Middleton, London, all of United Kingdom

[73] Assignee: Kimberly-Clark Limited, Northop, United Kingdom

[21] Appl. No.: 09/113,858

[22] Filed: Jul. 10, 1998

Related U.S. Application Data

[60] Provisional application No. 60/061,683, Oct. 10, 1997.

[51] Int. Cl.[7] ..... B65H 16/02; B65H 18/02

[52] U.S. Cl. ..... 242/593; 312/34.8; D6/522; D6/523

[58] Field of Search ..... 242/593, 588.3, 242/597.7; 312/34.8; D6/518, 521, 522, 523

[56] References Cited

U.S. PATENT DOCUMENTS

| | | | |
|---|---|---|---|
| D. 176,842 | 2/1956 | D'Ath | D6/518 |
| D. 234,733 | 4/1975 | Peasley | D6/518 |
| D. 238,731 | 2/1976 | Krueger | D6/518 |
| D. 342,635 | 12/1993 | Carter et al. | D6/518 |
| D. 385,734 | 11/1997 | Mervar et al. | D6/518 |
| D. 406,974 | 3/1999 | King et al. | D6/518 |
| 2,033,582 | 3/1936 | Materno | 206/57 |
| 2,948,486 | 8/1960 | Epeneter | 242/596.4 |
| 3,150,808 | 9/1964 | Vensel | 225/106 |
| 3,523,653 | 8/1970 | Hansen | 242/55.53 |
| 3,581,935 | 6/1971 | Chi | 221/1 |
| 3,749,296 | 7/1973 | Harrison | 225/106 |
| 4,009,682 | 3/1977 | Patel et al. | 225/106 |
| 4,274,573 | 6/1981 | Finkelstein | 225/106 |
| 4,963,406 | 10/1990 | Gooding, Jr. et al. | 428/43 |
| 5,065,924 | 11/1991 | Granger | 225/56 |
| 5,152,121 | 10/1992 | Nakamura | 53/431 |
| 5,205,454 | 4/1993 | Schutz et al. | 225/1 |
| 5,332,118 | 7/1994 | Muckenfuhs | 221/48 |
| 5,370,338 | 12/1994 | Lewis | 252/593 |
| 5,715,971 | 2/1998 | Morand | 242/593 |
| 5,765,718 | 6/1998 | Grasso et al. | 242/593 |

FOREIGN PATENT DOCUMENTS

| | | |
|---|---|---|
| 1297667 | 3/1992 | Canada . |
| 0107487A1 | 5/1984 | European Pat. Off. . |
| 0331653A2 | 9/1989 | European Pat. Off. . |
| 0480848A1 | 4/1992 | European Pat. Off. . |
| 956622 | 4/1964 | United Kingdom . |
| 2308114 | 6/1997 | United Kingdom . |
| 86/02247 | 4/1986 | WIPO . |

OTHER PUBLICATIONS

PCT Counterpart International Search Report mailed Jan. 13, 1999.

*Primary Examiner*—John Q. Nguyen
*Attorney, Agent, or Firm*—Scott B. Garrison

[57] ABSTRACT

A dispenser for center feed roll products includes a base and a cover adapted to fit the base. The cover further defines a cavity to receive the center feed roll product. The base further includes a roll platform and a securing means. The securing means defining an aperture is coupled to the roll platform and is adapted to support a center feed roll product. In addition, the securing means permits the installation of a roll product through the aperture and prevents the removal of the roll product.

28 Claims, 20 Drawing Sheets

SHEET MATERIAL DISPENSER

CROSS REFERENCE TO RELATED APPLICATIONS

This application claims the benefit of U.S. Provisional Application No. 60/061,683, filed Oct. 10, 1997.

FIELD OF THE INVENTION

This invention generally relates to dispensers. More specifically, this invention relates to sheet material dispensers.

BACKGROUND OF THE INVENTION

Desirably, a sheet material dispenser provides material, such as tissue or paper towels. One type of sheet material dispenser may be designed for center feed rolls. Desirably, center feed rolls dispense material from their core rather than their periphery, as opposed to conventional rolls. During dispensing, the roll may be stationary as material is dispensed from its center. An advantage of center feed rolls is their dispensers do not require moving parts, such as handles and rollers to rotate the roll, which are typically required with conventional roll dispensers.

Generally, center feed roll dispensers are top loading devices that include a mounting plate, a platform, and a cover. Typically, the mounting plate attaches to a substantially vertical wall and is formed integrally with the platform. The platform may form a opening at its center and extend substantially horizontally from the mounting plate. The platform may form a flat surface for receiving a center feed roll. Normally, material from the roll is dispensed through the opening. The cover may pivotally connect to or be positioned upon the mounting plate. The cover may rotate pivotally outward and downward, or be completely removable, to expose the platform permitting the placement of a center feed roll. Once pivoted downward, the cover may be pivoted upwardly to conceal the roll within the dispenser. Often a key locks the cover to the mounting plate for preventing the theft of the roll.

Unfortunately, these types of dispenser designs suffer several disadvantages. In many cases, a locking mechanism, such as a key padlock or a combination lock, must be used to secure the roll within the dispenser. Losing the key or forgetting the combination may result in damage to the lock and/or dispenser when trying to open the cover. Another disadvantage may occur during servicing. Because a center feed roll provides material from its center, it may be necessary to view either its top or bottom side to check the amount of material available. Opening the cover may fail to reveal the roll's top or bottom side because the roll's top side is often too high to be viewed and the bottom side view is blocked by the platform. As a result, checking the amount of remaining roll material may require opening the cover and removing the roll from the platform. At a minimum, the service technician's efficiency is probably impeded. Additionally, a substantially used roll may collapse during handling when verifying the amount of remaining sheet material, potentially jamming the dispenser. A further disadvantage is the dispenser may fail to protect the roll during cleaning. During cleaning, water may be sprayed at or near the dispenser. Because the dispenser opens at the top, water collecting at the upper surface may leak through the seam between the cover and mounting plate, and reach the roll. Water reaching the roll may degrade or even destroy the installed roll.

Accordingly, a material dispenser for a center feed roll that eliminates the need for a locking mechanism, improves serviceability, and prevents moisture, such as water, from reaching the roll will improve over conventional roll dispensers.

SUMMARY OF THE INVENTION

The problems and needs described above are addressed by the present invention which provides a dispenser for center feed roll products. Desirably, the dispenser includes a base and a cover adapted to fit the base. The cover may further define a cavity to receive the center feed roll product. The base may further include a roll platform and a securing means. The securing means defining an aperture may be coupled to the roll platform and adapted to support a center feed roll product. In addition, the securing means may permit the installation of a roll product through the aperture and prevent the removal of the roll product.

The roll dispenser may further include a mounting member coupled to the roll platform. In addition, the securing means may further include a hinge which may pivot inward into the cavity permitting placement of the roll product within the dispenser and return to a dispensing position to secure the roll product for dispensing. Moreover, the securing means may further include at least one buttress coupled to the hinge to prevent the hinge from pivoting past the dispensing position.

In addition, the dispenser may further include a supporting means bracing the securing means. Additionally, the supporting means may be a second flap that may include a protrusion and a tab coupled to the base.

What is more, the roll dispenser may further include a door defining an aperture coupled to the base by a living hinge. Moreover, the door may further include a sealing member coupled to the door and a latching assembly coupling the door to the base. Also, the sealing member may be positionable to substantially seal the door aperture for preventing liquids from entering the dispenser.

Likewise, the dispenser may further include a door defining an aperture coupled to the base. The door may include a supporting means having a hinge support coupled to the door, an aperture disc coupled to the door and surrounding the door aperture to aid the tearing of roll products, and a sealing member. What is more, the aperture disc may be constructed from an elastomeric material.

Moreover, the dispenser may further include a latching assembly coupling the door to the base so that the latching assembly may support the weight of the roll product inside of the dispenser.

Alternatively, the door may include a supporting means and a protruding member coupled to the door. The supporting means may further include a protruding member extending in a first direction. The protruding member coupled to the door and positioned in the aperture of the door may extend in a second direction substantially opposite of the first direction. As a result, a roll product withdrawn from the dispenser follows a serpentine path around the protruding members.

In addition, the cover may be constructed from a semi-transparent material for viewing the roll product within. Alternatively, the cover may be constructed from an opaque material forming a window for viewing the roll product within.

In another embodiment of the invention, the dispenser may include a base, a cover, a door, and a latching assembly.

Desirably, the base further includes a mounting member, a roll platform, and a securing means defining an aperture. The mounting member and the securing means may be coupled to the roll platform. The securing means may permit the installation of a roll product through the aperture and prevent the removal of the roll product.

Desirably, the cover is adapted to fit the base. The cover may be constructed from a semi-transparent or translucent material for viewing the roll product within. Desirably, the door defining an aperture is pivotally coupled to the base. The door may include a supporting means and a protruding member coupled to the door. The supporting means may further include a protruding member extending in a first direction. The protruding member coupled to the door and positioned in the aperture of the door may extend in a second direction substantially opposite of the first direction. As a result, a roll product withdrawn from the dispenser follows a serpentine path around the protruding members. The latching assembly may couple the door to the base and support the weight of the roll product inside of the dispenser.

In a further embodiment of the invention, the dispenser, desirably, includes a base, a cover, a door, and a latching assembly. The base may further include a mounting member, a roll platform, and a securing means defining an aperture. The mounting member and securing means may be coupled to the roll platform. The securing means may permit the installation of a roll product through the aperture and prevent the removal of the roll product. Desirably, the securing means includes a substantially circular member having a plurality of hinges, which pivot substantially upward permitting the placement of the roll product within the dispenser and return substantially horizontal for securing the roll product.

Desirably, the cover is adapted to fit the base. The cover may be constructed from a semi-transparent or translucent material for viewing the roll product within. The cover and base may be sized to receive roll products having a diameter between about 150 millimeters to about 225 millimeters and a width between about 5 millimeters to about 245 millimeters. Furthermore, it is contemplated that the cover and base may be sized to accommodate other roll sizes.

Desirably, the door defining an aperture is coupled to the base. The door may include a supporting means and a protruding member coupled to the door. The supporting means may further include a protruding member extending in a first direction. The protruding member coupled to the door and positioned in the aperture of the door may extend in a second direction substantially opposite of the first direction. As a result, a roll product withdrawn from the dispenser follows a serpentine path around the protruding members.

Desirably, the latching assembly includes a latch and a catch and couples the door to the base. In addition, the latching assembly may support the weight of the roll product inside of the dispenser.

In still another embodiment of the present invention, desirably the dispenser for sheet material products defines an aperture permitting only a substantially upward or inward installation of a sheet material product substantially within the dispenser.

These and various other advantages and features of novelty which characterize the invention are provided throughout this disclosure. However, for a better understanding of the invention, its advantages, and the objects obtained by its use, reference should be made to the drawings which form a further part hereof, and to the accompanying description of the invention.

DEFINITIONS

The term "sheet material" as used herein refers to a material that is thin in comparison to its length and breadth. Generally speaking, sheet materials should exhibit a relatively flat planar configuration and be flexible permitting folding, rolling, stacking, or the like. Exemplary sheet materials include, but not limited to, paper tissue, paper towels, label rolls, or other fibrous, film, polymers, or filamenting products.

The term "center feed roll product" as used herein desirably refers to sheet material wound cylindrically about a center, but permitting the removal of material from the center. Desirably, as the center feed roll product is consumed, sheet material eventually dispenses from the roll's periphery. An exemplary center feed roll product is shown in FIG. 28. Center feed roll products are also described by patent publications, such as UK Patent Application 2,308,114A published Jun. 6, 1997.

The term "mechanical fasteners" as used herein desirably refers to devices that fasten, join, connect, secure, hold, or clamp components together. Mechanical fasteners include, but are not limited to, screws, nuts and bolts, rivets, snap-fits, tacks, nails, loop fasteners, and interlocking male/female connectors, such as fishhook connectors. A fish hook connector includes a male portion with a protrusion on its circumference.

Inserting the male portion into the female portion substantially permanently locks the two portions together.

The term "hinge" as used herein desirably refers to a jointed or flexible device that connects and permits pivoting or turning of a part to a stationary component. Hinges include, but are not limited to, metal pivotable connectors, such as those used to fasten a door to frame, and living hinges. Living hinges may be constructed from plastic and formed integrally between two members. A living hinge permits pivotable movement of one member in relation to another connected member.

The term "couple" as used herein includes, but not limited to, joining, connecting, fastening, linking, or associating two things integrally or interstitially together.

DETAILED DESCRIPTION

Figure 1:
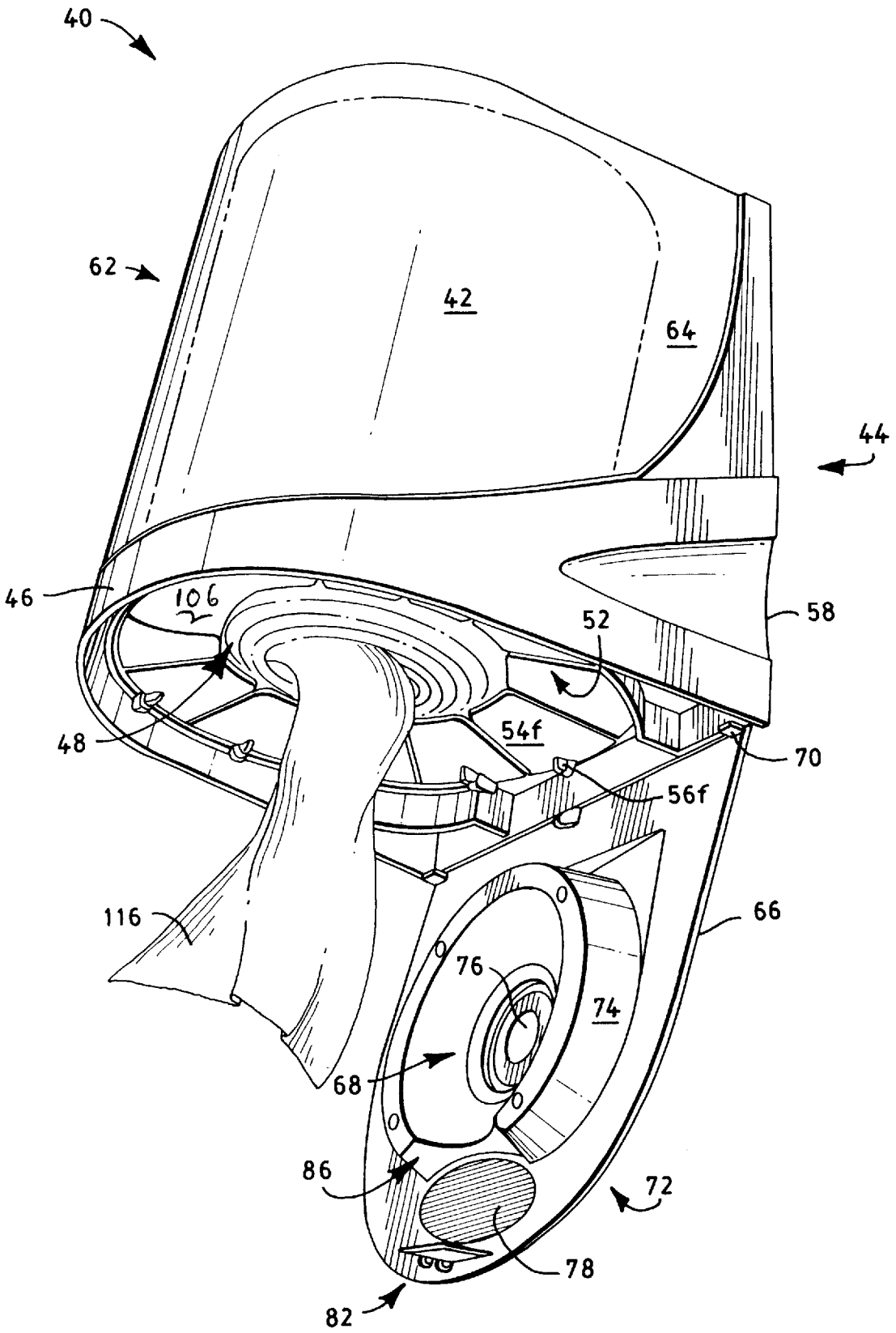
FIG. 1 is a perspective view of one embodiment of a material dispenser housing a center feed roll within.
Figure 2:
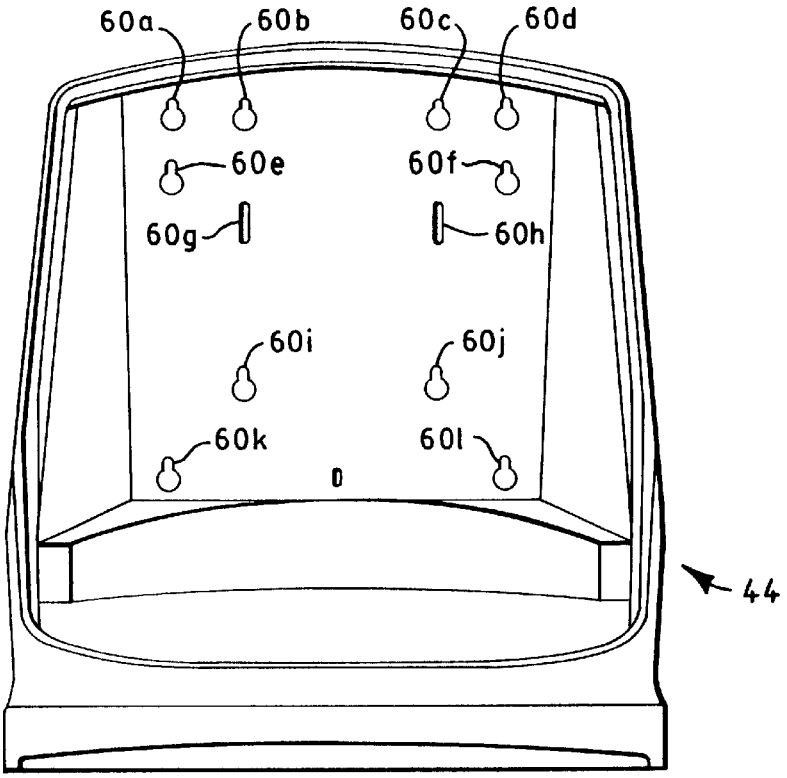
FIG. 2 is a front, elevational view of a base of one embodiment of the material dispenser.

Referring now to the drawings, wherein the reference numerals designate corresponding structure throughout the views, and referring in particular to FIGS. 1–16, there is shown (not necessarily to scale) an exemplary improved material dispenser 40 for a sheet material product, such as a center feed roll product 42. The material dispenser 40 may include a substantially L-shaped base 44, a cover 62, a door 66 and a latching assembly 82. The base 44 and cover 62 may be constructed from metal, plastic, or other composite materials. Desirably, the base 44 is constructed from polypropylene and the cover 62 is constructed from polystyrene, polypropylene, polyethylene, or other thermoplastics. The cover 62 may connect to the base 44 using any suitable means, such as adhesives, welds, or mechanical fasteners. Alternatively, the cover 62 may be adapted to loosely fit over or formed integrally with the base 44. Regardless of how the cover 62 is connected, desirably the cover 62 and base 44 form a cavity 64 for housing the center feed roll product 42. In one embodiment, the cover 62 is constructed from a semi-transparent or translucent material permitting viewing of the roll product 42 within. Alternatively, the cover 62 may be constructed from an opaque material, and optionally, may surround a transparent material serving as a window.

As shown in FIGS. 2–5, the base 44 may include a roll platform 46, a securing means 52, and a mounting member 58. The roll platform 46 may be formed integrally with the mounting member 58. The roll platform 46 may be formed integrally with a catch 92 of the latching assembly 82, which is described in further detail hereinafter. The mounting member 58 may form a plurality of mounting apertures 60*a–l* permitting attaching of the member 58 with mechanical fasteners to a support structure, such as a wall. Alternatively and/or additionally, the mounting member 58 may be fixed to a support structure using any suitable means, such as adhesives or welds.

Figure 3:
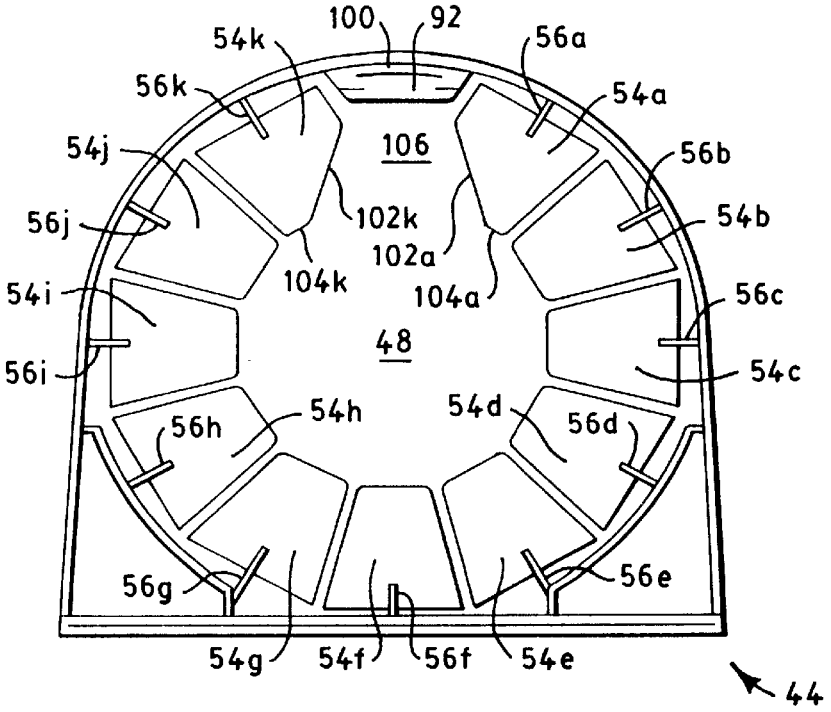
FIG. 3 is a bottom, plan view of the base of one embodiment of the material dispenser.
Figure 4:
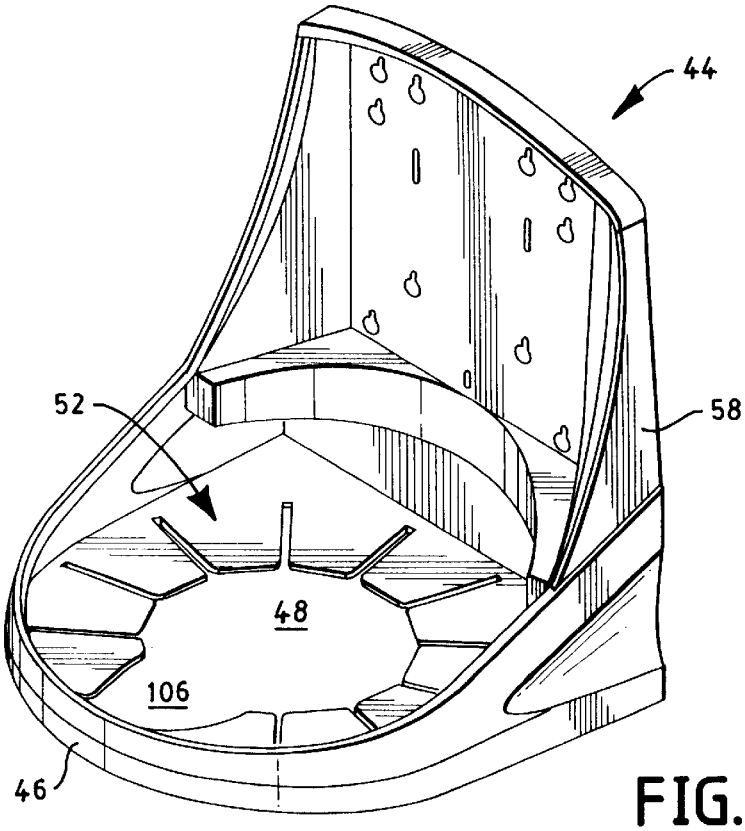
FIG. 4 is a perspective view of the base of one embodiment of the material dispenser.
Figure 5:
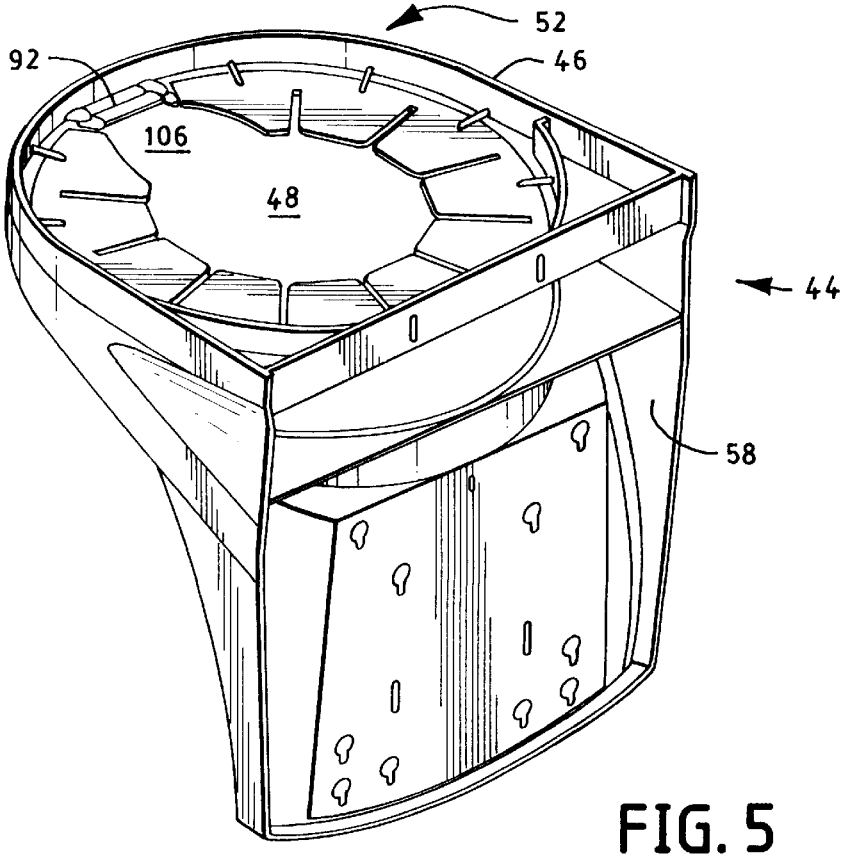
FIG. 5 is an inverted, perspective view of the base of one embodiment of the material dispenser.
Figure 6:
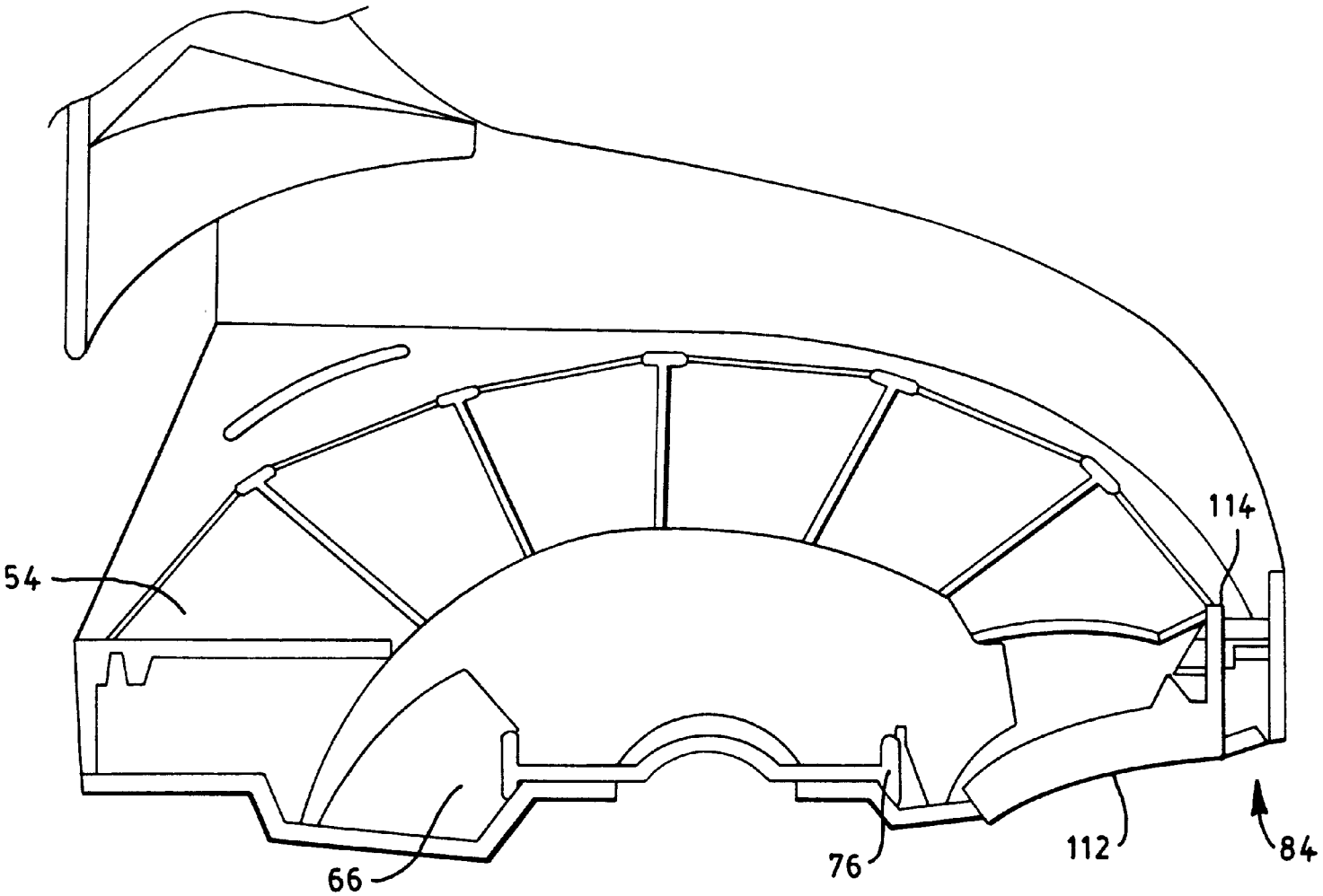
FIG. 6 is a perspective, cross-sectional view of a base portion of one embodiment of the material dispenser.
Figure 7:
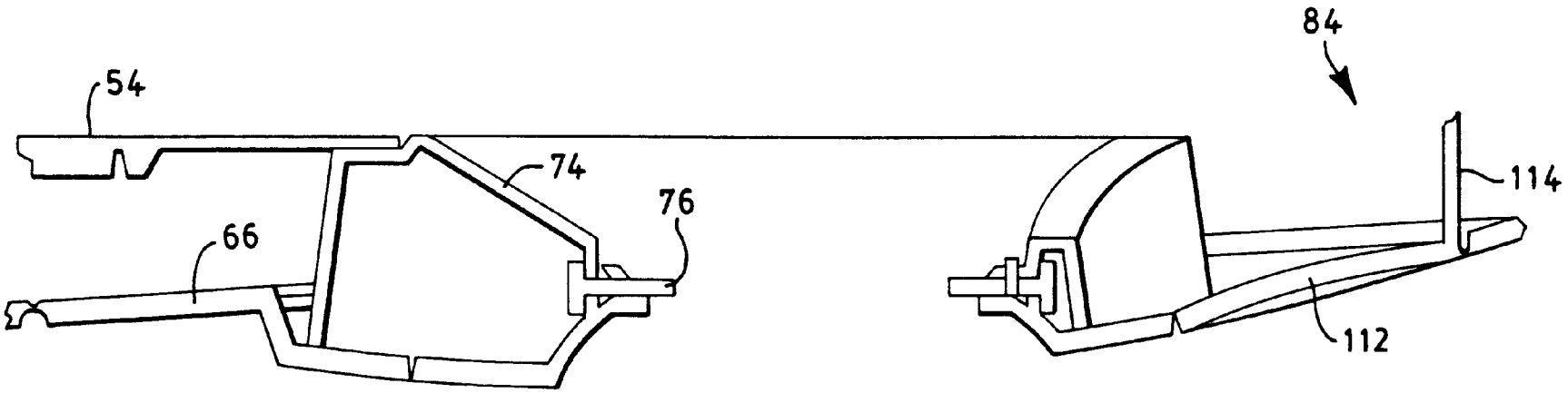
FIG. 7 is a cross-sectional view of the base portion of one embodiment of the material dispenser.

Desirably, the securing means 52 is formed integrally with the roll platform 46. Alternatively, the securing means may be connected to the roll platform 46 using any suitable means such as adhesives, welds or mechanical fasteners. The securing means 52, desirably substantially circular, may form a substantially circular aperture 48, may be positioned inside of the roll platform 46, and may include at least one hinge 54*f*. As shown in FIG. 3, an exemplary embodiment may include eleven hinges 54*a–k* ringing the substantially circular aperture 48 and may be formed integrally with the roll platform 46 by any suitable means, such as, for example, respective living hinges. The length of the hinges 54*a–k* may be varied depending on the diameter size of the inserted roll products 42. The securing means 52 may further include a respective buttress 56*a–k* mounted on the underside of each hinge 54*a–k*. Desirably, the hinges 54*a–k* only pivot upwardly, thereby allowing the insertion of the roll product 42 into the cavity 64, but not its removal. The buttresses 56*a–k* may reinforce the hinges 54*a–k* so they pivot only in one direction from a substantially horizontal or dispensing position. Alternatively, no buttresses 56*a–k* may be placed on the hinges 54*a–k* permitting the hinges 54*a–k* to pivot up or down from a substantially horizontal position.

Referring to FIG. 3, hinges 54*a* and 54*k* may have respective tapered edges 102*a* and 102*k* that terminate forming respective tips 104*a* and 104*k*. As a result, the hinges 54*a* and 54*k* desirably form an opening 106. Desirably, the opening 106 permits the removal of an operator's hand after installing the roll product 42 in the cavity 64. In addition, the opening 106 permits verifying the amount of sheet material on the roll product 42.

Figures 8, 9:
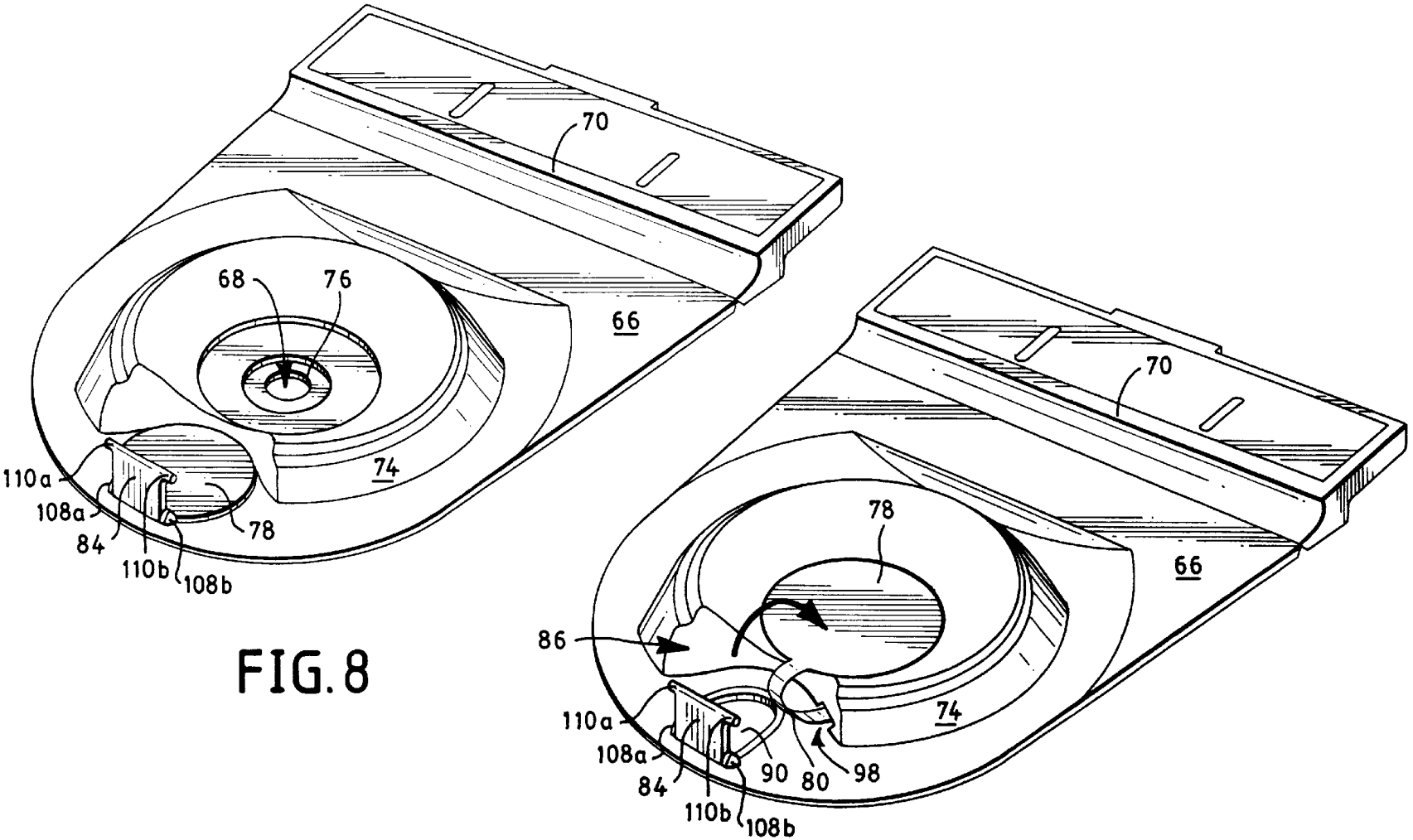
FIG. 8 is a perspective view of the door and sealing member of one embodiment of the material dispenser.
FIG. 9 is a perspective view of the door and sealing member covering a door aperture of one embodiment of the material dispenser

Referring to FIGS. 1 and 8–9, the door 66 forming an aperture 68 may be formed integrally with the roll platform 46 or connected to the roll platform 46 using any suitable means, such as adhesives, welds, or mechanical fasteners. The door 66 pivotally opens by a living hinge 70, although other hinges may be used, such as a plurality of metal hinges, which permits the installing or viewing of the roll product 42.

The door 66 may include a supporting means 72, a door aperture disc 76, and a sealing member 78. The disc 76 may be substantially circular, but other shapes may be used. The disc 76 is desirably constructed from an elastomeric material, which aids in tearing sheet material. Exemplary elastomeric materials include, but are not limited to, urethane rubbers, natural rubbers, and A-B-A block copolymers. The supporting means 72 may include a substantially circular hinge support 74 connected to the door 66, using any suitable means, such as welds, adhesives or mechanical fasteners. The support 74 may form a grooved section 86 and a channel 98. When the door is shut, desirably the support 74 presses against the undersides of the hinges 54*a–k*, thereby providing the hinges 54*a–k* added support for the weight of the roll product 42, which relieves pressure from the buttresses 56*a–k* during dispensing.

Desirably, the sealing member 78 is formed integrally with a strap 80, which resides within the channel 98 of the support 74 and connects to the support 74 using any suitable means, such as welds, adhesives, or mechanical fasteners. Alternatively, the strap 80 connects to the door 66 using any suitable means, such as welds, adhesives, or mechanical fasteners. When the aperture 68 is uncovered, the sealing member 78 may reside between the grooved section of the support 74 and the latching assembly 82. The sealing member 78 may be moved to seal the aperture 68 to prevent water from reaching the roll product 42 during cleaning. To seal the aperture 68, the door 66 is opened. Next, the sealing member 78 is removed from between the latching assembly 82 and support 74, and twisted and positioned to over the aperture 68 as shown in FIG. 9.

Figure 10:
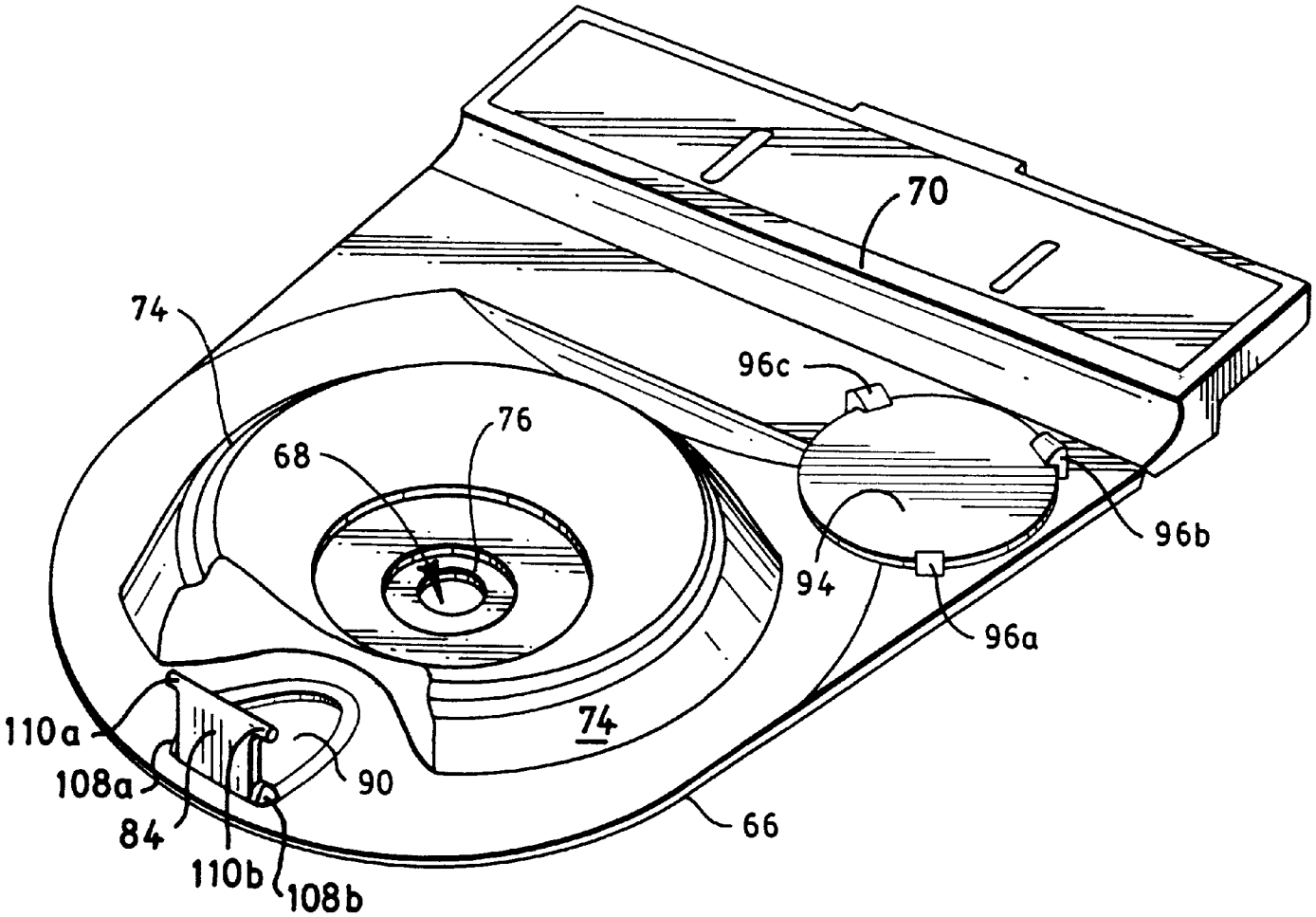
FIG. 10 is a perspective view of the door and an alternative embodiment of the sealing member of one embodiment of the material dispenser.
Figure 11:
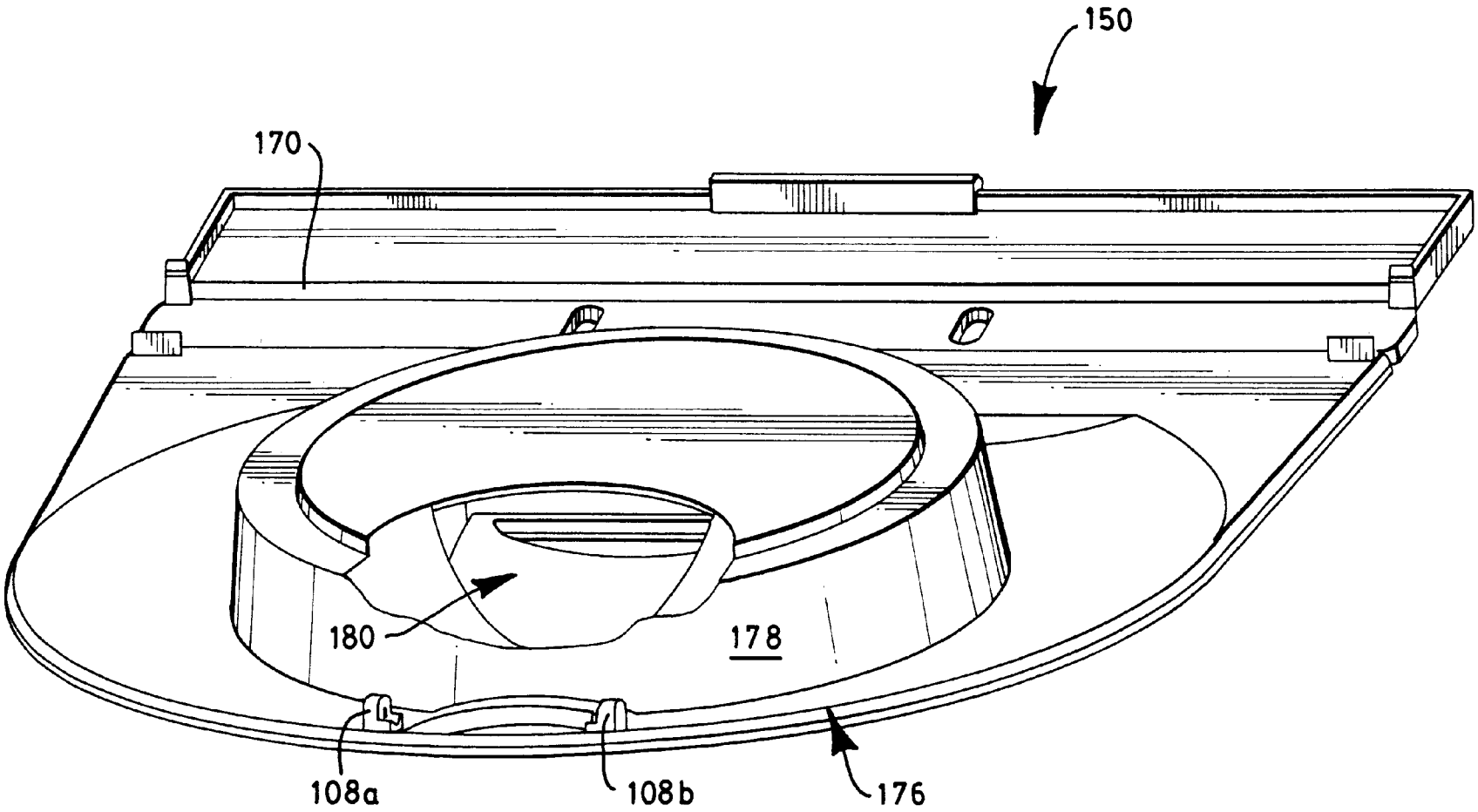
FIG. 11 is a perspective view of an alternative embodiment of a door for the material dispenser.
Figure 12:
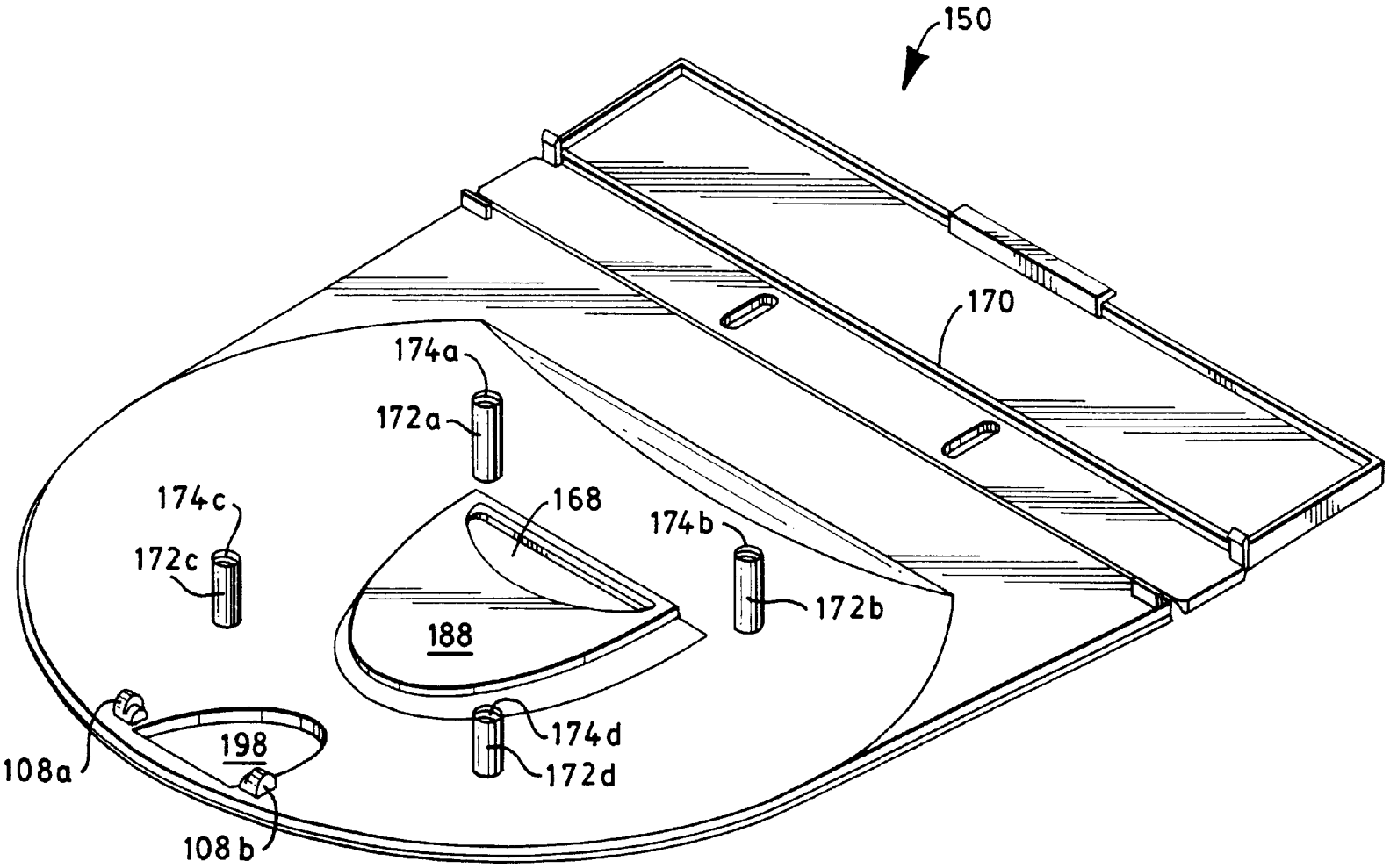
FIG. 12 is a perspective view of an alternative embodiment of a door for the material dispenser without a hinge support.
Figure 14:
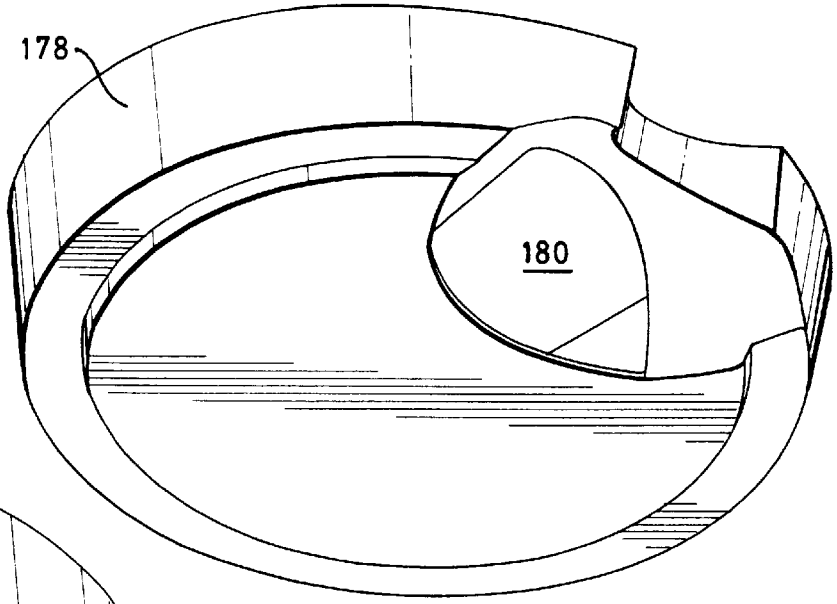
FIG. 14 is a top, perspective view of a hinge support.

An alternative embodiment of the sealing member is illustrated in FIG. 10. A sealing member 94 may have a plurality of clips formed integrally with the door 66, desirably three clips 96*a–c*, permitting releasable connection with the door 66. The sealing member 94 is a discrete, removable unit permitting its placement over the aperture 68.

Referring to FIGS. 1, 3, and 7–9, the latching assembly 82 may include a latch 84, posts 108*a–b*, and the catch 92, and may be designed to support the weight of the roll product 42 placed inside the dispenser 40. In addition, the door 66 desirably forms a latch aperture 90. The posts 108*a–b* may be positioned in opposed relation and formed integrally with the door 66. Desirably, the substantially L-shaped latch 84 is secured pivotally at its convergence between the two posts 108*a–b* and includes a base 112 formed integrally with a post 114, which terminates forming protrusions 110*a–b*. The base 112 may reside within the latch aperture 90. The corresponding catch 92 may be formed integrally in the underside of the base 44 and forms a slot 100. Shutting the door 66 inserts the post 114 into the slot 100 of the catch 92. The weight of the latch 84 presses the protrusions 108*a–b* against the interior of the catch 92, thereby maintaining the door 66 shut. Releasing the latch 84 by pressing the base 112 through the latch aperture 90 pivots the post 114 freeing the protrusions 110*a–b* from the catch 92. Once the protrusions 110*a–b* are free of the catch 92, the door 66 maybe opened permitting the placement or inspection of the roll product 42 within the dispenser 40.

Figure 25:
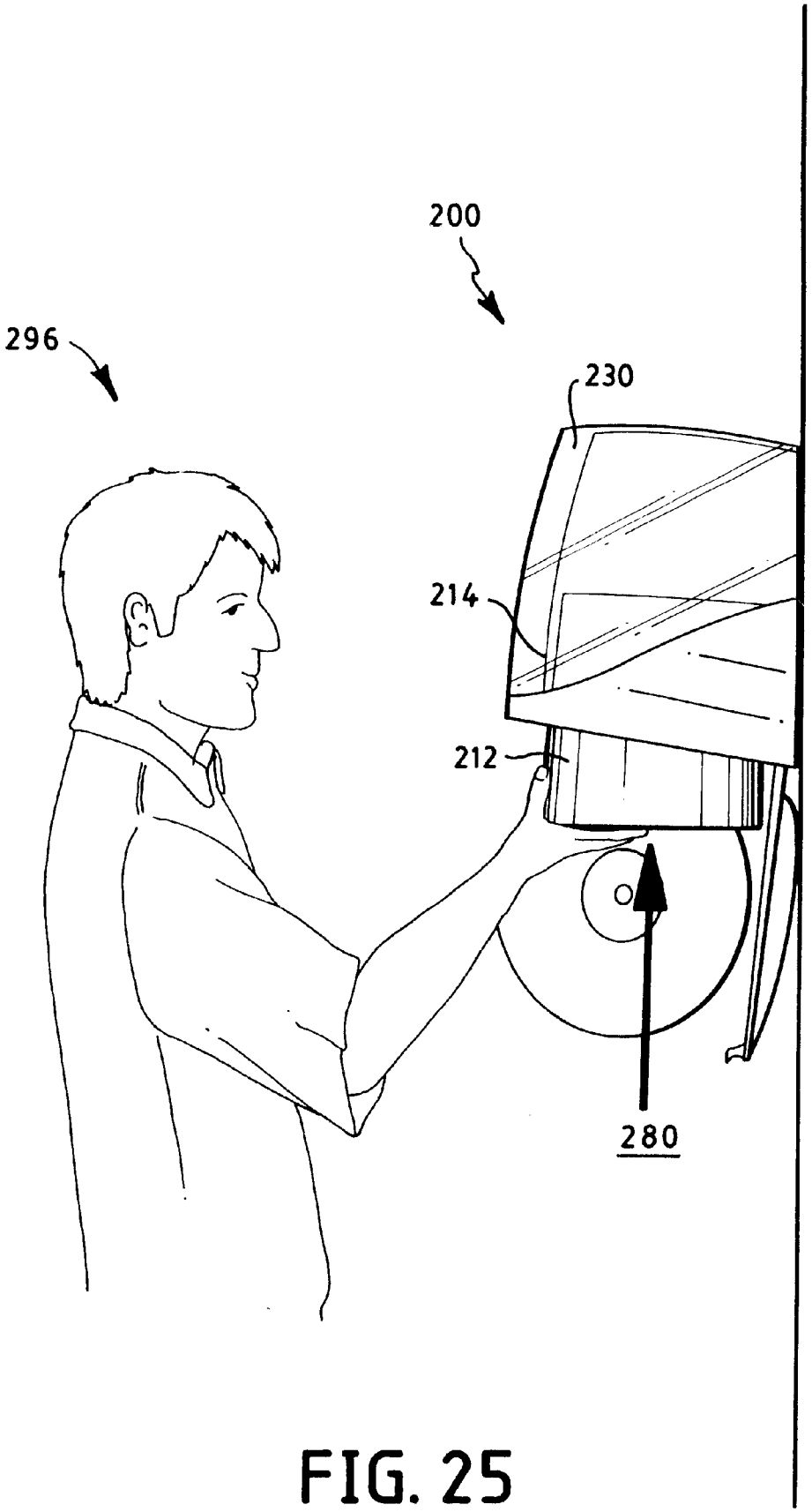
FIG. 25 is a side view of an operator installing a center feed roll into the material dispenser.

Desirably, installing the roll product 42 in the dispenser 40 begins operation. Pressing the base 112 may release the latch 84 from the catch 92 resulting in the door 66 pivoting open. The roll product 42 may be installed in a substantially upward direction, similarly as depicted in FIG. 25, which will be described in further detail hereinafter. The roll product 42 may be inserted into the dispenser 40 past the hinges 54*a–k*.

Initially, when the roll product 42 contacts the hinges 54*a–k*, they may pivot upward from a substantially horizontal or dispensing position permitting the roll product 42 to pass. Once the roll product 42 passes the hinges 54*a–k*, the hinges 54*a–k* may return to their dispensing position, which in this desirable embodiment is substantially horizontal. Afterwards, the roll product 42 may be set upon the hinges 54*a–k*. The buttresses 56*a–k* aid in supporting the weight of the roll product 42. After insertion, the roll product 42 may be very difficult to remove, thereby deterring theft. Next, a sheet material portion 116 from the center of the roll product 42 may be unraveled and fed through the aperture 68 in the door 66. Shutting the door 66 may permit operation of the dispenser 40.

Pulling the sheet material vertically downward unravels portions of sheet material for use. Pulling the sheet material at angle from vertical results in friction between the sheet material and door aperture disc. As a result, the sheet material may be torn separating a portion for use.

If verifying the amount of sheet material left on the roll product 42 is desired, releasing the latch 84 may open the door 66. Looking upward into the opening 106 may permit verifying the amount of sheet material left on the roll product 42. If washing the dispenser 40 is desired, sheet material may be pulled toward the roll product 42 through the aperture 68 and positioned inside of the dispenser 40. The sealing member 78 (or 94) may be placed over the aperture 68 and the door 66 may be shut. Vigorous washing of the dispenser 40 may be conducted, while minimizing the amount of water entering the cavity 64. After washing, the door 66 may be opened, the sealing member 78 (or 94) may be placed back to its original position, and the sheet material may be fed through the aperture 68. Closing the door 66 may permit dispensing to resume.

An alternative embodiment of the door 150 may be used with the dispenser 40 as shown in FIGS. 11–16. The door 150 may be formed integrally with the roll platform 46 or connected to the roll platform 46 using any suitable means, such as adhesives, welds, or mechanical fasteners. The door 150 pivotally opens by a living hinge 70, although other hinges may be used, such as a plurality of metal hinges, which permits the installing or viewing of the roll product 42. Desirably, the door 150 forms an aperture 168 and a latch aperture 198, and includes a supporting means 176, a protruding member 188, and posts 172*a–d* forming respective post apertures 174*a–d*.

Figure 13:
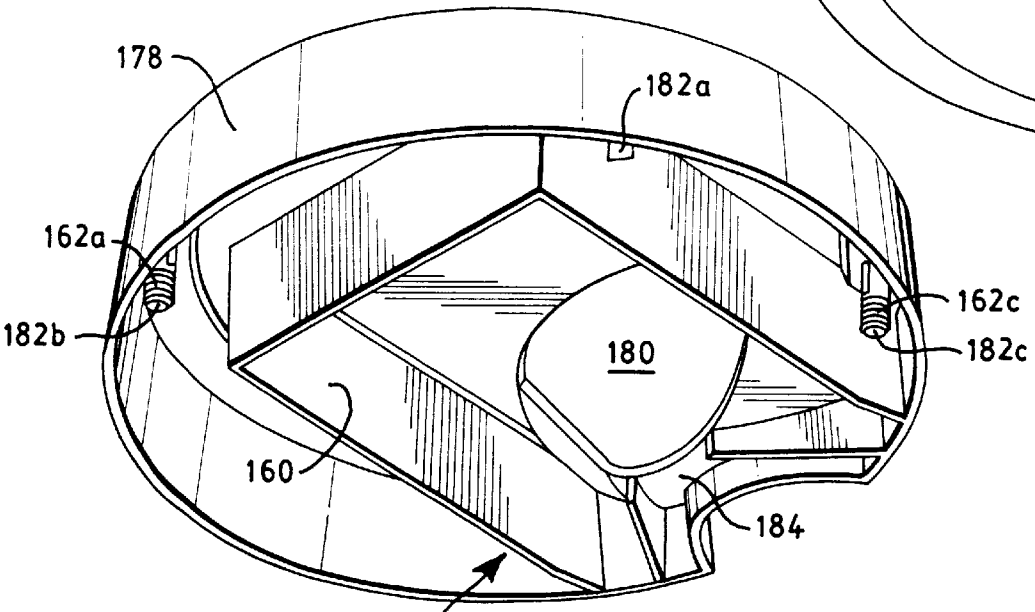
FIG. 13 is a bottom, perspective view of a hinge support.

Desirably, the supporting means 176 includes a substantially circular hinge support 178 forming an aperture 180 that may be connected to the door 150 using any suitable means, such as welds, adhesives or mechanical fasteners. In this desirable embodiment as shown in FIG. 13, the support 178 includes four posts 182*a–d* (posts 182*a* and 182*d* not shown) formed integrally on the underside of the support 178, a protruding member 184, and a view shield member 160.

Desirably, the support 178 connects to the door 150 by inserting posts 182*a–d* into respective post apertures 174*a–d*. Desirably, each support post 182*a–d* has a plurality of annular bulges 162*a–d* that seat within the annular grooves of the respective bores of the door posts 172*a–d*, locking the support posts 182*a–d* and door posts 172*a–d* together and thereby fastening the support 178 to the door 150. When the door 150 is shut, the support 178 may press against the undersides of the hinges 54*a–k*, thereby providing the hinges 54*a–k* added support for the weight of the roll product 42, which may relieve pressure from the buttresses 56*a–k* during dispensing. The view shield member 160 may be formed integrally with the underside of the support 178, and may prevent the viewing of the cavity 64 from underneath the dispenser 40 and debris from collecting between the hinge support 178 and the door 150. In this desired embodiment, the shield member 160 is generally U-shaped, but other shapes may also be used.

Figure 15:
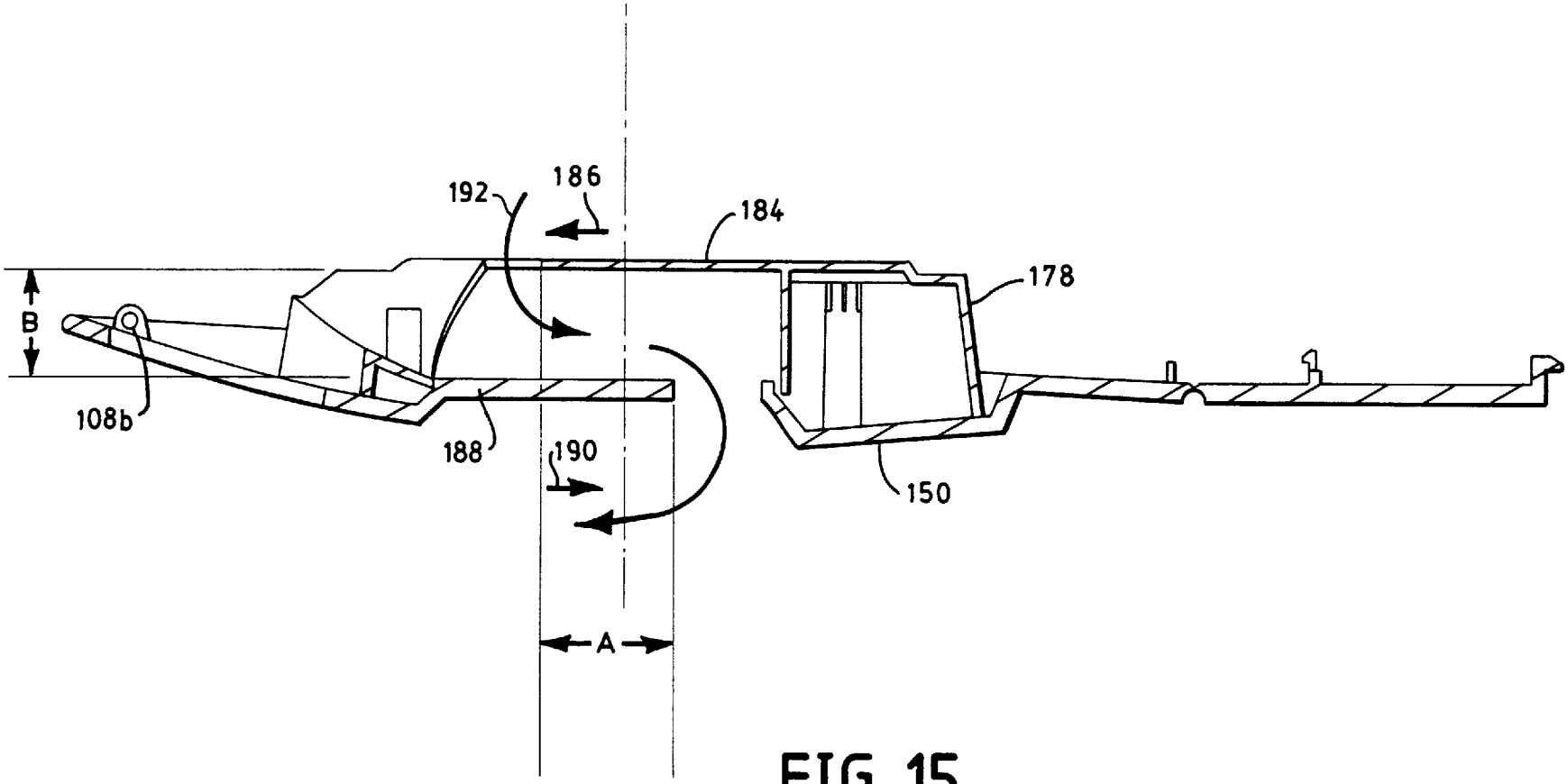
FIG. 15 is a cross-sectional view of the alternative embodiment of a door for the material dispenser.
Figure 16:
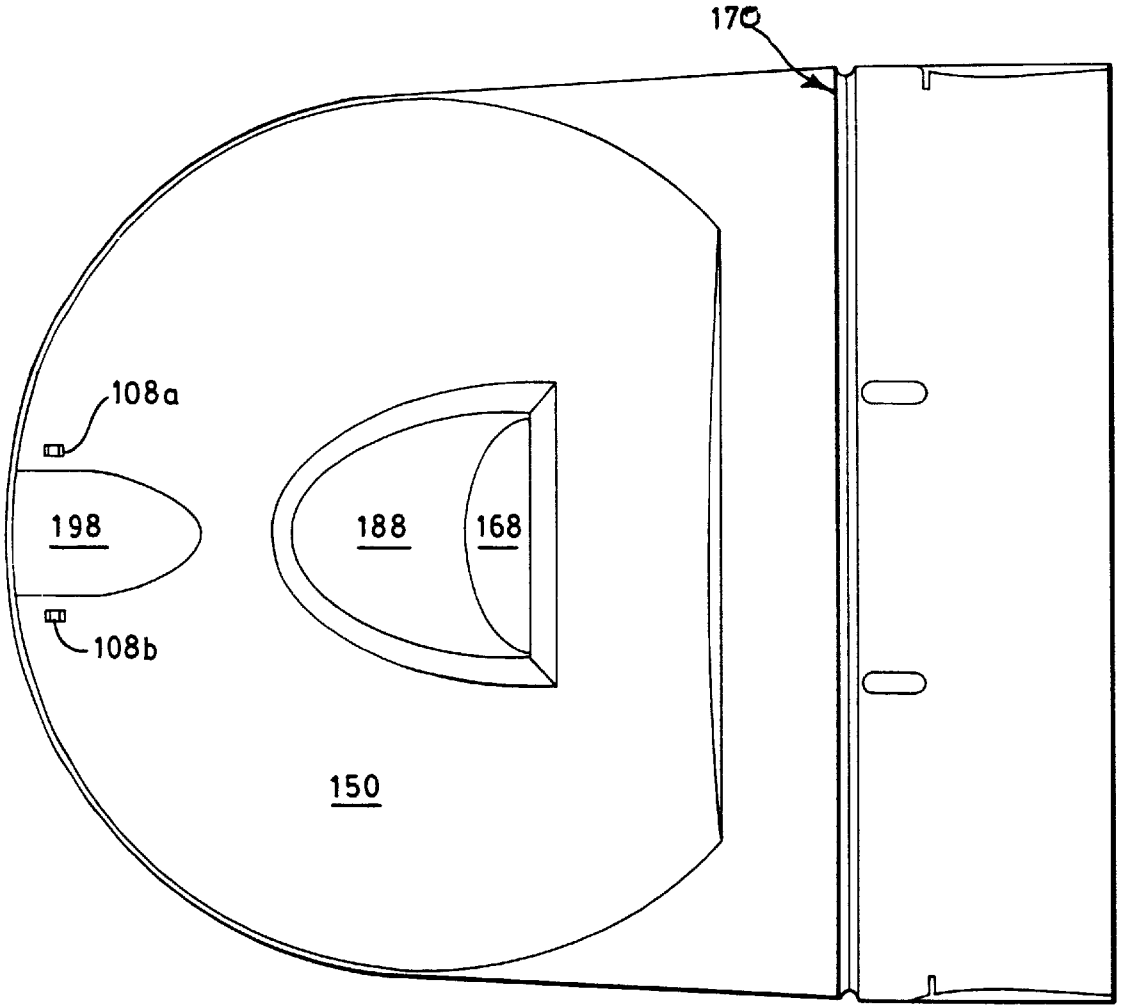
FIG. 16 is a bottom, plan view of the alternative embodiment of a door for the material dispenser.

Referring now to FIG. 15, the protruding member 184 of the support 178 may extend in a first direction 186, which in this desired embodiment is substantially horizontal. The protruding member 188 of the door 150 may extend in a second direction 190, which in this desired embodiment is substantially horizontal and opposite of the first direction. These members 184 and 188 form a serpentine path 192 for a sheet of roll product 42 to travel from the roll product 42 to the user.

Typically, roll products 42 have sheet materials that vary not only in composition, but also in the structure of perforations between individual sheets. This variance affects the tearing of the sheet material into individual segments. As shown in FIG. 15, the support 178 and door 150 may be modified to vary a distance "A", which is the overlapping region of the protruding members 184 and 188, and to vary a distance "B" , which is the distance, in this embodiment a vertical distance, between protruding members 184 and 188. Changing these distances will alter the resistance of the sheet through the serpentine path 192 to accommodate the varying separation strengths of sheet material. For example, if the separation strength of the sheet is relatively strong, the distance "B" may be minimized and/or the distance "A" may be maximized. Conversely, if the separation strength of the sheet is relatively weak, the distance "B" may be maximized and/or the distance "A" may be minimized. However, there are some considerations with regard to varying the distance "B". If the distance "B" is increased, the dispenser 40 size may be increased as well. If the distance "B" is minimized, it may become difficult to hand feed sheet material through the path 192 to begin dispensing, as described further hereinafter.

The configuration of the door 150 and support 178 provide some advantages when separating individual segments of sheet material for use. When pulling apart the individual sheets, the perforations tear simultaneously rather than sequentially. Simultaneous tearing minimizes rips in the body of the sheets outside of the perforations, which is particularly useful with sheets having a tendency to tear along the length of the sheet. Furthermore, this simultaneous tearing mechanism may be used with offset two-ply center feed rolls, which will be described in further detail hereinafter. Another advantage of this configuration is preventing the streaming or twisting of material dispensed from a newly inserted center feed roll product 42. The material is dispensed flat and smooth without twists and excess dispensing of sheets. This prevents waste of roll product 42 material.

The latching assembly 82 may be coupled to the door 150 and operates the same as previously described. Desirably, the latching assembly 82 includes the latch 84, although the latch 84 is not shown in FIGS. 11–16.

Typically, installing a roll product 42 in the dispenser 40 may begin operation. Pressing the base 112 may release the latch 84 from the catch 92 resulting in the door 150 pivoting open. The roll product 42 may be installed in a substantially upward direction, similarly as depicted in FIG. 25, which will be described in further detail hereinafter. Desirably, the roll product 42 is inserted into the dispenser 40 past the hinges 54*a–k*. Initially, when the roll product 42 contacts the hinges 54*a–k*, they may pivot upward permitting the roll product 42 to pass. Once the roll product 42 passes the hinges 54*a–k*, the hinges 54*a–k* may return to their dispensing position, which in this desirable embodiment is substantially horizontal. Afterwards, the roll product 42 may be set upon the hinges 54*a–k*. The buttresses 56*a–k* may aid in supporting the weight of the roll product 42. After inserting the roll product 42, it may be very difficult to remove, thereby deterring theft. Next, a sheet material portion 116 from the center of the roll product 42 may be unraveled and fed through the serpentine path 192 formed by the support 178 and door 150 to the exterior of the dispenser 40. Shutting the door 150 may permit operation of the dispenser 40.

Pulling the sheet material perpendicular to the door 150 may feed material from the dispenser 40. If a segment of sheet material is desired, raising the material parallel to the door 150 and pulling may separate a segment.

If verifying the amount of sheet material on a roll product 42 is desired, releasing the latch 192 may open the door 150. Looking upward into the opening 106 may permit verifying the amount of sheet material left on the roll product 42. If washing the dispenser 40 is desired, sheet material may be pulled toward the roll product 42 through the serpentine path 192 and positioned inside of the dispenser 40. Shutting the door 150 may permit vigorous washing of the dispenser 40, while minimizing the amount of water entering the cavity 64. The configuration of the door 150 and support 178, namely forming the serpentine path 192, may prevent water from reaching the roll product 42. After washing, the door 150 may be opened and the sheet material may be fed through the serpentine path 192 to the exterior of the dispenser 40. Closing the door 150 may permit dispensing to resume.

Figure 17:
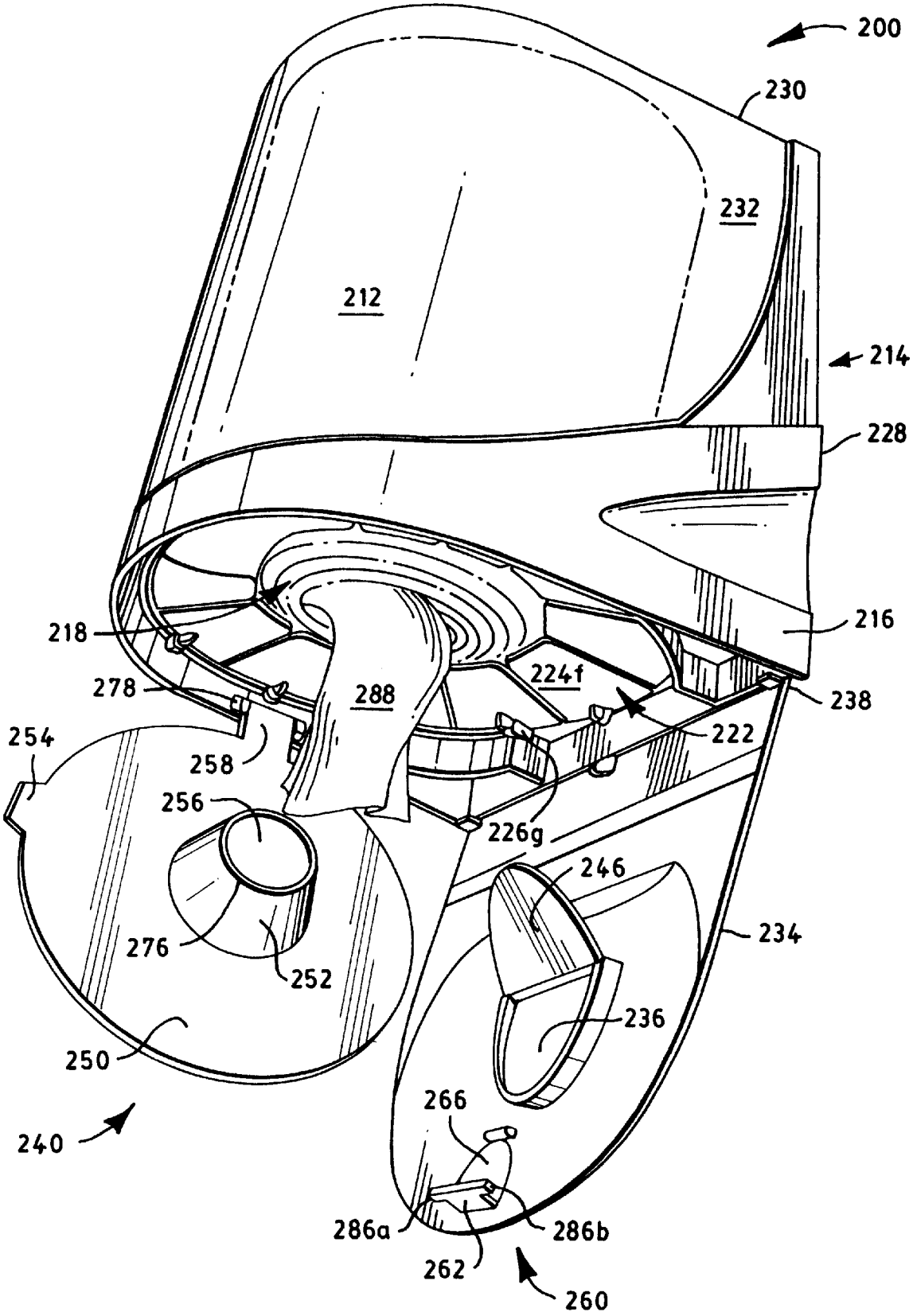
FIG. 17 is a perspective view of another embodiment of a material dispenser housing a center feed roll within.
Figure 18:
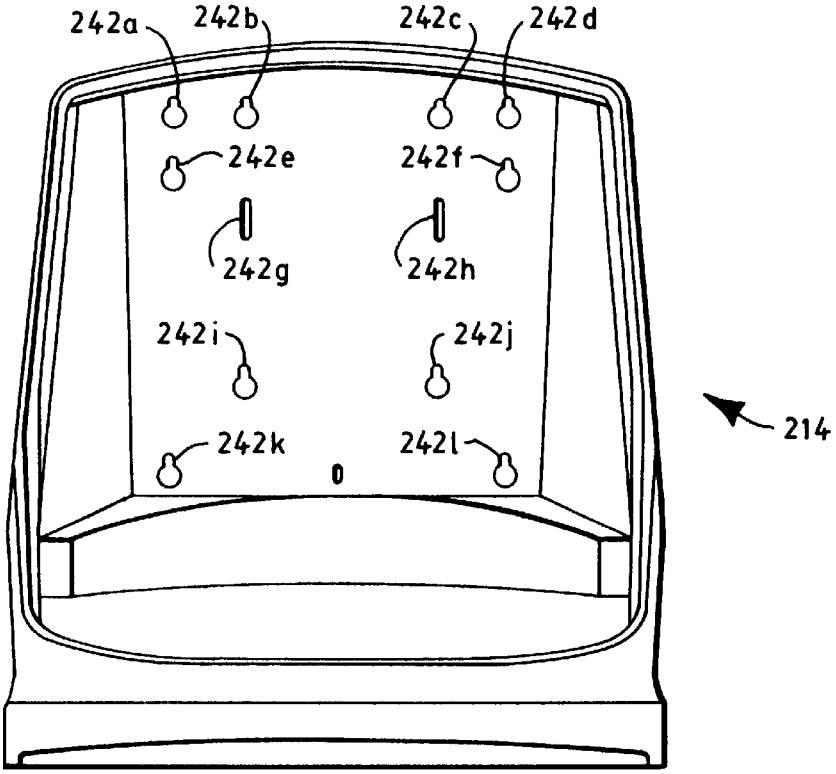
FIG. 18 is a front, elevational view of a base for the material dispenser.

Another desirable embodiment of a dispenser 200 for a sheet material product, such as a center feed roll product 212, is illustrated in FIGS. 17–26. The material dispenser includes a substantially L-shaped base 214, a cover 230, a supporting means 240, a door 234, and a latching assembly 260 as shown in FIG. 17. The base 214 and cover 230 may be constructed from metal or plastic. Desirably, the base 214 is constructed from polypropylene and the cover 230 is constructed from polystyrene, polypropylene, polyethylene, or other thermoplastics. The cover 230 may connect to the base 214 using any suitable means, such as adhesives, welds, or mechanical fasteners. Alternatively, the cover 230 may be adapted to loosely fit over or formed integrally with the base 214. Regardless of how the cover 230 is connected, the cover 230 and base 214 may form a cavity 232 for housing the center feed roll product 212. In one embodiment, the cover 230 is constructed from a semi-transparent or translucent material permitting viewing of the roll product 212 within. Alternatively, the cover 230 may be constructed from an opaque material, and optionally, may surround a transparent material serving as a window.

Desirably, the base 214 includes a roll platform 216, a securing means 222, and a mounting member 228 as shown in FIGS. 18–21. The roll platform 216 may be formed integrally with the mounting member 228. The roll platform 216 may be also formed integrally with a catch 268 of the latching assembly 260, which is described in further detail hereinafter. Desirably, the mounting member 228 includes a plurality of mounting apertures 242*a–l* permitting attaching of the member 228 with mechanical fasteners to a support structure, such as a wall. Alternatively, the mounting member 228 may be fixed to a support structure using any suitable means such as adhesives or welds.

Figure 19:
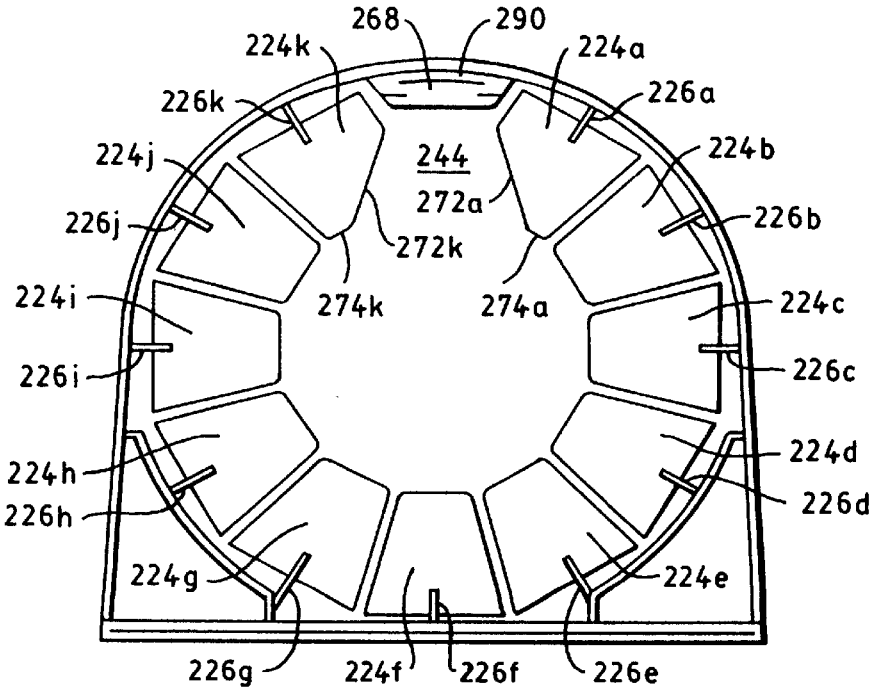
FIG. 19 is a bottom, plan view of the base for the material dispenser.
Figure 20:
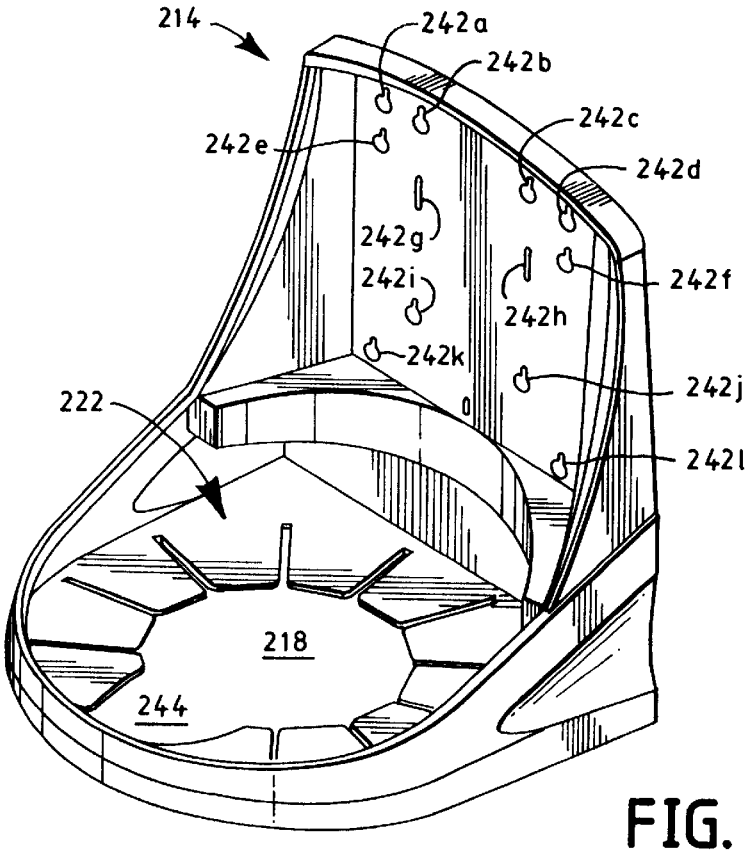
FIG. 20 is a perspective view of the base for the material dispenser.
Figure 21:
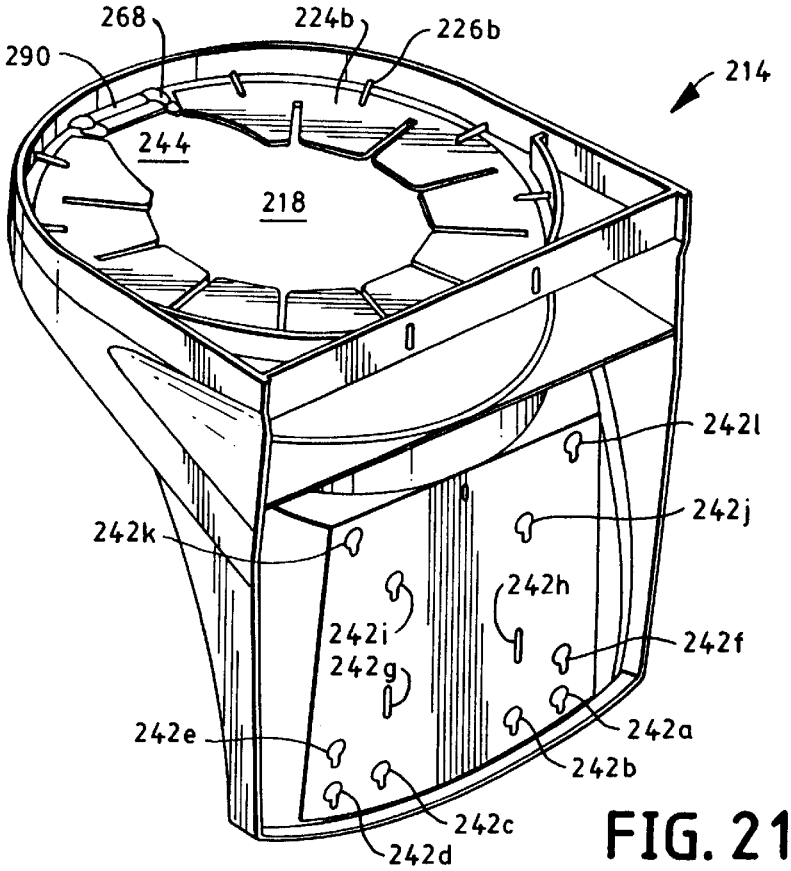
FIG. 21 is an inverted, perspective view of the base for the material dispenser.

Desirably, the securing means 222 is formed integrally with the roll platform 216 as shown in FIGS. 19 and 20. Alternatively, the securing means 222 is connected to the roll platform 216 using any suitable means such as adhesives, welds, or mechanical fasteners. The securing means 222, desirably substantially circular, may form a substantially circular aperture 218, may be positioned inside of the roll platform 216, and may include at least one hinge 224f. Desirably, eleven hinges 224*a–k* ring the substantially circular roll platform 216 and may be formed integrally with the roll platform 216 by a respective living hinge as shown in FIG. 19. The length of the hinges 224*a–k* may be varied depending on the diameter size of the roll product 212. A respective buttress 226*a–k* may be mounted on the underside of each hinge 224*a–k* for reinforcement. Desirably, the hinges 224*a–k* only pivot upwardly from a substantially horizontal position, thereby allowing the insertion of the roll product 212 into the cavity 232, but not its removal.

Alternatively, no buttresses 226*a–k* may be attached to the hinges 224*a–k* permitting the hinges 224*a–k* to pivot up or down from a substantially horizontal position.

Desirably, hinges 224*a* and 224*k* have respective tapered edges 272*a* and 272*k* that terminate forming respective tips 274*a* and 274*k*. As a result, the hinges 22*a* and 226*k* may form an opening 244. The opening 244 permits the removal of an operator's hand after installing the roll product 212 in the cavity 232. In addition, the opening 244 permits verifying the amount of sheet material on the roll product 212.

Desirably, the supporting means 240 includes a flap 5250, a tab 254, a conical protrusion 252 forming an aperture 256, and an extension 258 as shown in FIG. 17. The substantially circular flap 250 may be formed integrally with the conical protrusion 252, tab 254, and extension 258. Although one tab 254 is shown in this desired embodiment, a plurality of tabs 254 may be formed integrally with the flap 250. Although the flap 250 in this desired embodiment is substantially circular, it may be designed in other shapes as well. The conical protrusion 252 may terminate in a circular edge 276 for tearing sheet material, which is described in further detail hereinafter. The extension 258 may extend through an aperture 278 in the roll platform 216 and fasten thereto, thereby connecting the flap 250 with the roll platform 216. The flap 250 may be secured by bending the flap 250 at the extension 258 upward and twisting the flap 250 to clip the tab 254 onto the securing means 222. The flap 250 may press against the undersides of the hinges 224*a–k*, thereby desirably providing the hinges 224*a–k* added support for the weight of the roll product 212 and relieving pressure from the buttresses 226*a–k* during dispensing. To remove the flap 250, the tab 254 may be unclipped and the flap 250 may be removed from the securing means 222.

Figure 24:
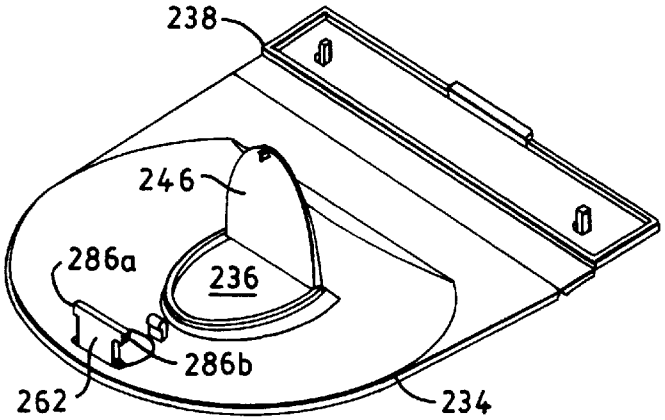
FIG. 24 is a perspective view of the door for another embodiment of the material dispenser.
Figure 23:
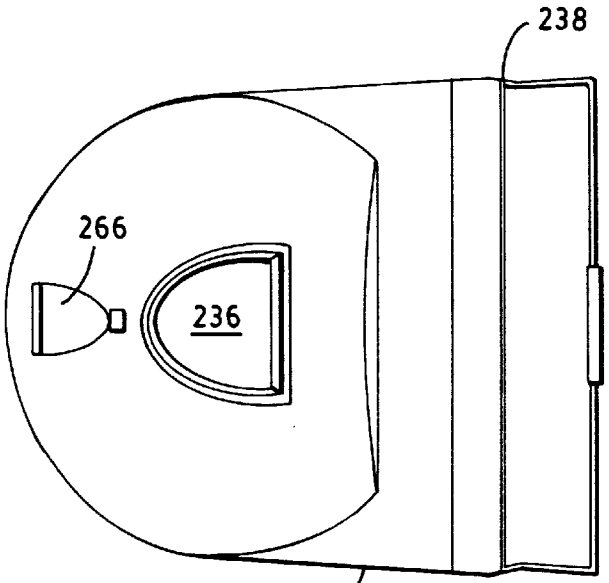
FIG. 23 is a top, plan view of the door for another embodiment of the material dispenser.
Figure 22:
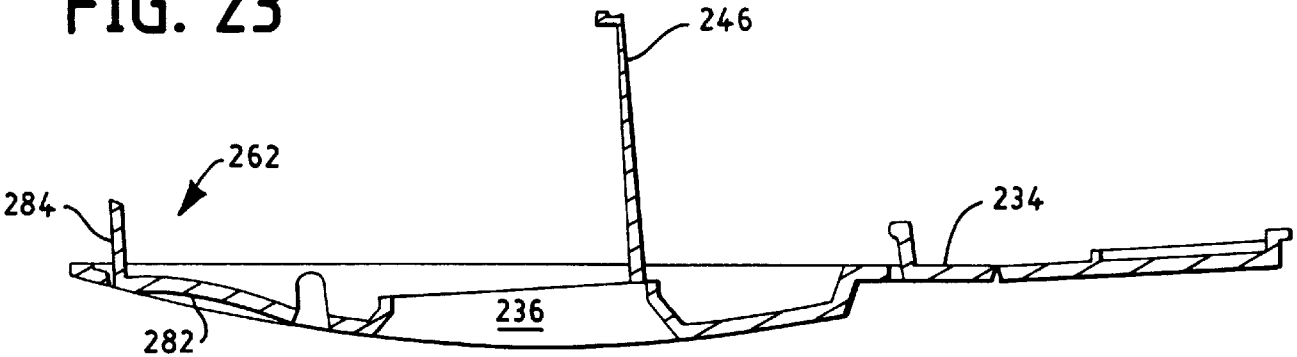
FIG. 22 is a cross-sectional view of a door for another embodiment of the material dispenser.

The door 234 forming an aperture 236 may be formed integrally with the roll platform 216 or connected to the roll platform 216 using any suitable means, such as adhesives, welds, or mechanical fasteners. The door 234 may pivotally open by a living hinge 70, although other pivotal connectors may be used, such as separate metal hinges, which may permit the installing or viewing of the roll product 212. Desirably, the door 234 includes a sealing member 246 as shown in FIGS. 22 and 24. The sealing member 246 may be formed integrally with the door 234 by a hinge, although other pivotal connectors may be used.

Desirably, the latching assembly 260 includes a latch 262 and the catch 268 as shown in FIG. 19 and FIGS. 22–24. In addition, the door 234 may form a latch aperture 266. The substantially L-shaped latch 262 may be pivotally secured at its convergence to the door 234 with a hinge and may include a base 282 formed integrally with a post 284, which may terminate forming protrusions 286*a–b*. The base 282 may reside within the latch aperture 266. The corresponding catch 268 may be formed integrally in the underside of the base 214 and form a slot 290. Shutting the door 234 inserts the post 284 into the slot 290 of the catch 268. The weight of the latch 262 may press the protrusions 286*a–b* against the interior of the catch 268, thereby maintaining the door 234 shut. Releasing the latch 262 by pressing the base 282 through the latch aperture 266 may pivot the post 284 freeing the protrusions 286*a–b* from the catch 268. Once the protrusions 286*a–b* are free of the catch 268, the door 234 may be opened permitting the placement or inspection of the roll product 212 within the dispenser 200.

Desirably, installing the roll product 212 in the dispenser 200 begins operation. Pressing the base 282 may release the latch 262 from the catch 268 resulting in the door 234 pivoting open. If the flap 250 is secured to the securing means 222, unclipping the tab 254 from the securing means 222 may release the flap 250, permitting the lowering of the flap 250. The roll product 212 may be installed in a substantially upward direction 280, with a single hand if desired, by an operator 296, as depicted in FIG. 25. The roll product 212 may be inserted into the dispenser 200 past the hinges 224*a–k*. Initially, when the roll product 212 contacts the hinges 224*a–k*, they may pivot upward permitting the roll product 212 to pass. Once the roll product 212 passes the hinges 224*a–k*, the hinges 224*a–k* may return to their dispensing position, which in this desirable embodiment is substantially horizontal. Afterwards, the roll product 212 may be set upon the hinges 224*a–k*. The buttresses 226*a–k* may aid in supporting the weight of the roll product 212. After inserting the roll product 212, it may not be removed, thereby deterring theft. Next, a material sheet portion 288 may be fed through the aperture 256 of the conical protrusion 252 past the flap 250. Afterwards, the sheet material portion 288 may be fed through the aperture 236 in the door 234. Shutting the flap 250 and door 234 may permit operation of the dispenser 200.

Pulling the sheet material vertically downward may unravel portions of sheet material for use. Pulling the sheet material at an angle from vertical may result in friction between the sheet material and the conical protrusion edge 276. As a result, the sheet material may tear separating a portion for use.

If verifying the amount of sheet material left on the roll product 212 is desired, releasing the latch 262 may open the door 234. Looking upward into the opening 244 may permit verifying the amount of sheet material on the roll product 212. If washing the dispenser 200 is desired, the sheet material may be pulled toward the roll product 212 through the apertures 236 and 256, and positioned inside of the dispenser 200. The sealing member 246 may be pivoted over the aperture 236. Next the flap 250 may be secured to the securing means 222 and the door 234 may be shut. Vigorous washing of the dispenser 200 may be conducted, while minimizing the amount of water entering the cavity 232. After washing, the door 234 may be opened, the sealing member 246 may be pivoted backward to its original position, and the sheet material may be fed through the apertures 256 and 236. Afterwards, the flap 250 may be pivoted upward and secured to the securing means 222. Closing the door 234 may permit dispensing to resume.

Figure 26:
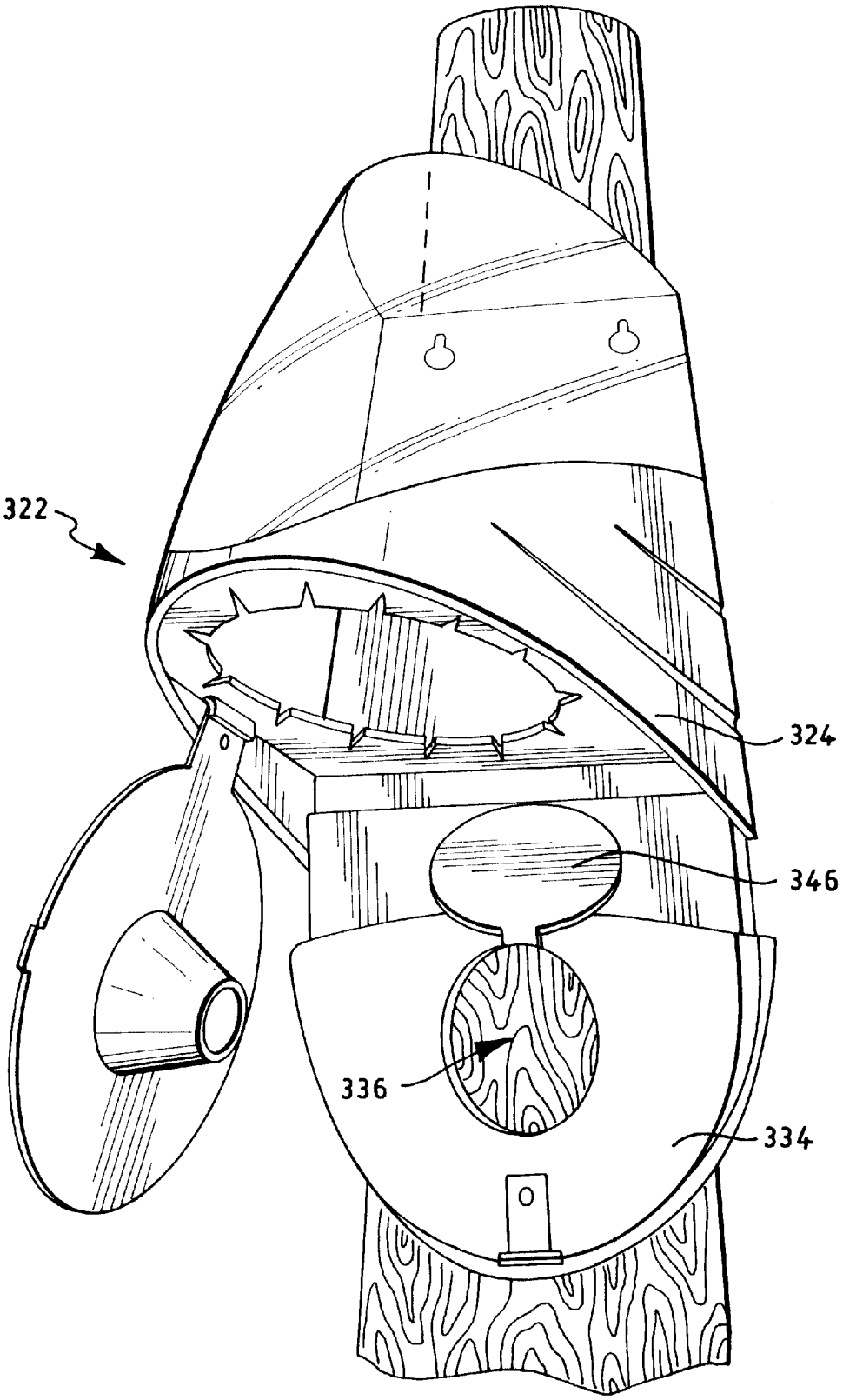
FIG. 26 is a perspective view of an alternative version of a securing means and door for another embodiment of the material dispenser.

Alternative embodiments the securing means and door are depicted in FIG. 26. Desirably, the securing means 322 includes a plurality of hinges 324 arranged in a substantially unbroken circular pattern. The door 334 forming an aperture 336 may include a sealing member 346. Desirably, both the aperture 336 and sealing member 346 are substantially circular.

Desirably, cylindrical-shaped center feed roll products are used in presented embodiments of the invention. These roll products may have dimensions of width, which is a distance between the circular ends of the roll product, ranging from about 5 to about 245 millimeters and diameter, which is a straight line passing through a center of one of the circular ends of the roll product, ranging from about 150 to about 225 millimeters. More desirably, these roll products may have dimensions of width ranging from about 50 to about 245 millimeters. Even more desirable, these roll products may have dimensions of width of about 200 millimeters and diameter greater than about 200 millimeters to about 250 millimeters.

Figure 27:
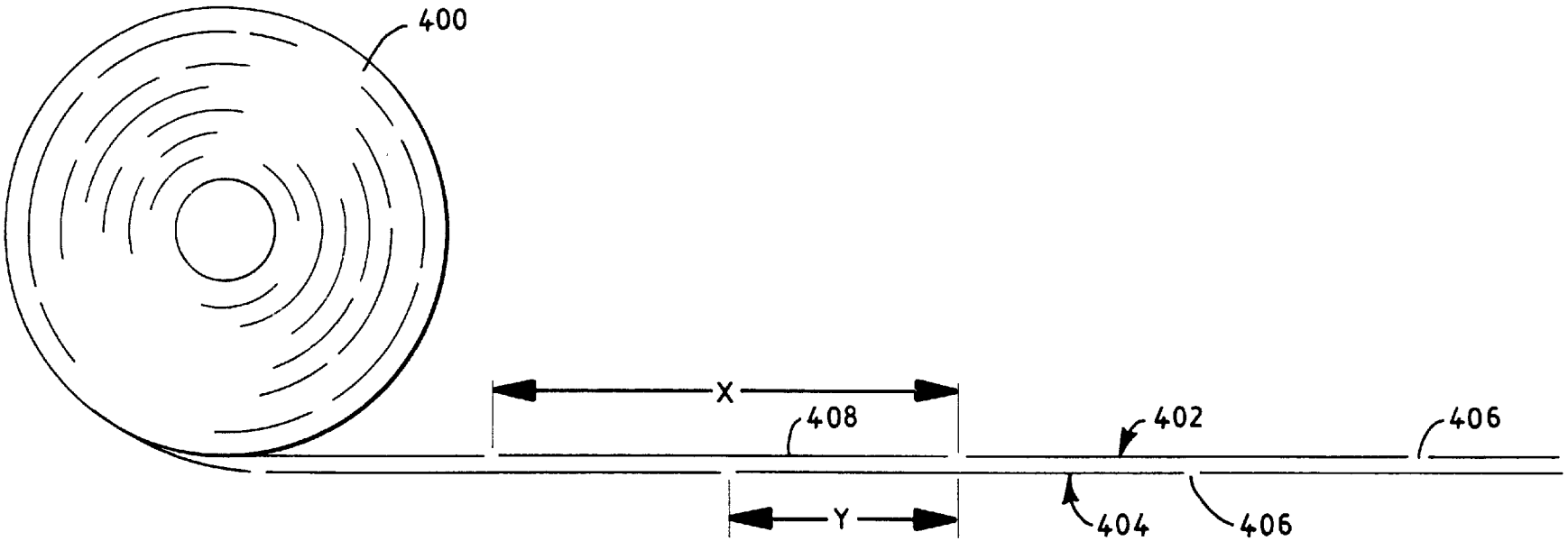
FIG. 27 illustrates a plan view of a desirable center feed roll product to be used with the depicted dispenser embodiments.

Although several types of sheet material products may be used in the presented dispenser embodiments, such as stacks of interfolded wipers, one exemplary sheet material product is a center feed roll or barrel roll 400 illustrated in FIG. 27. The roll 400 has been unwound slightly from its outer surface to show the offset perforation arrangement. It should be understood that in use, the webs will be fed out from the inner surface, and the webs on the outer surface will usually be secured to one another so that the roll 400 does not unwind as shown in the figure.

Desirably, the roll 400 includes an inner web 402 and an outer web 404 each having perforations 406, which may allow individual sheets 408 to be detached from the webs 402 and 404. The individual sheets 408 have a length X. The roll 400 is made from paper and is suitable for use as a hand towel or other wiper. The offset of the perforations 406 is shown as length Y, and in this desirable embodiment has an offset of 50/50.

Figure 28:
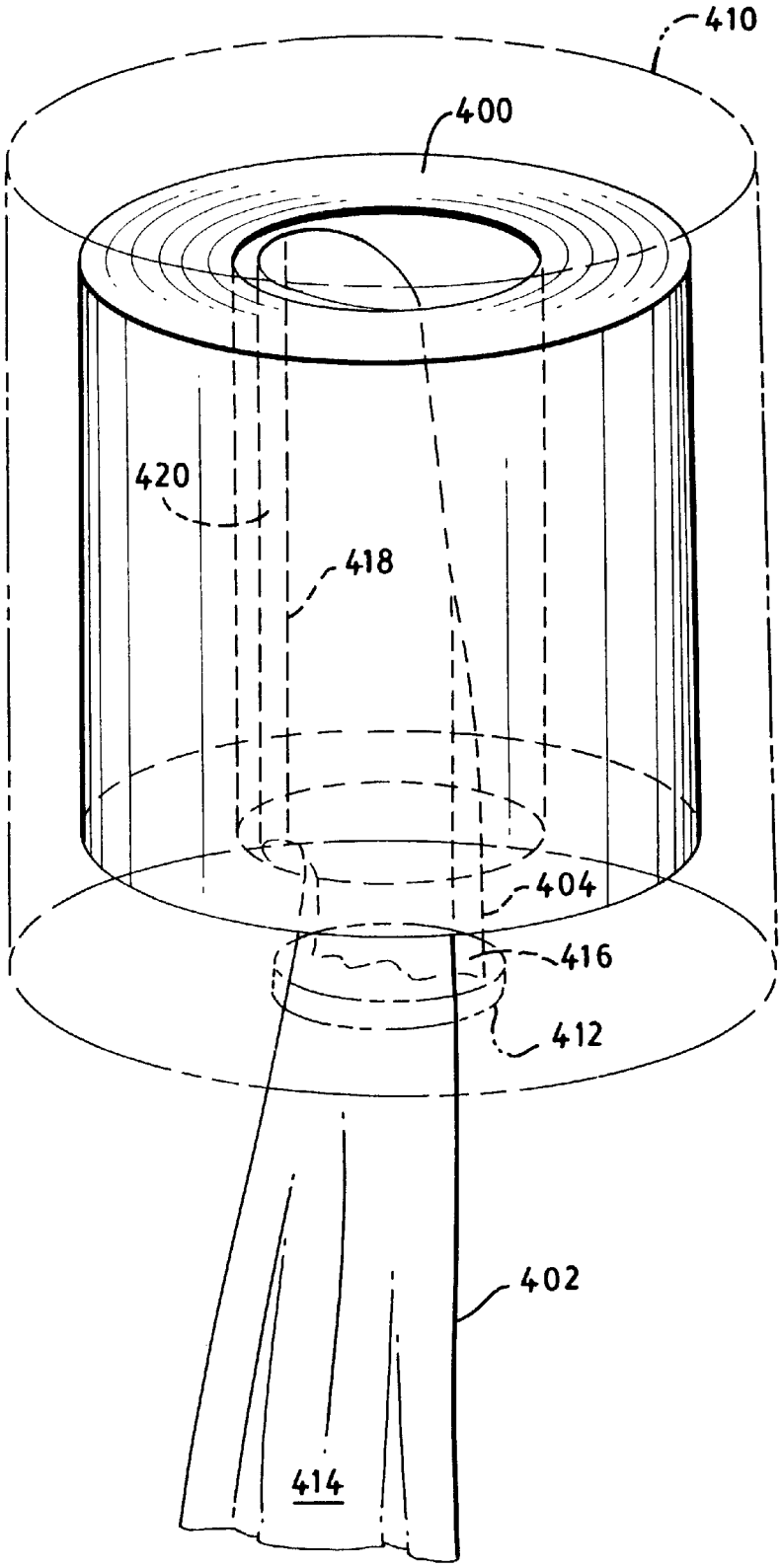
FIG. 28 illustrates a perspective view of the center feed roll of FIG. 27 in use in a dispenser.

FIG. 28 illustrates the roll 400 in use in a dispenser 410. The dispenser 410 is shown in outline only for simplicity of the figure. Desirably, inner and outer webs 402 and 404 are fed through the aperture 412 of the dispenser 410, and due to the offset perforations 418, the sheet 414 of the inner web 402 protrudes from the dispenser 410 further than the sheet 416 of the outer web 404. When a sheet is to be dispensed, the user may grip the sheet 414 and pull downwards until the friction force between the inner web 402 and the rim of the aperture 412 passes across perforations 418. Desirably, the sheet 414 will then detach leaving the end of the next sheet 420 of the inner web 402 at the aperture 412. While the inner web 402 is being pulled, the outer web 404 is simultaneously moved downwards by virtue of it being wound with the inner web 402, and by the time the sheet 414 has become detached, the sheet 416 will be protruding from the dispenser 410 by a similar amount to the sheet 414 as shown in the diagram. Thus, the sheets are presented from alternate webs.

Kimberly-Clark Europe standard test procedure number KCN-060 can be used to test the detaching strength of the line of perforations. This test uses an Instron Universal Testing Instrument to simulate a detaching action between two adjacent sheets of the perforated product. For a 200 mm wide roll, the sheets are folded into thirds along the machine direction and placed in the 3 inch (76 mm) jaws of the Instron instrument before the test is begun. The jaws initially have a gap of 102±2 mm, and the top jaw is moved upwards at a constant rate of 250 mm/min away from the bottom jaw until the perforations are broken. Total energy (kg/mm), peak load (g), percentage stretch at peak (%) and total stretch as a percentage (%) can be measured.

The material tensile strength can also be measured in this way, using an unperforated sample, in the chosen direction (normally the machine direction). In practice a 50 mm wide sample is tested, and the result multiplied by 4 to obtain the tensile strength for a 200 mm wide roll.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A dispenser for center feed roll products, the dispenser comprising:

a base, the base including a securing means defining an aperture, the securing means adapted to permit installation of a new fully wound center feed roll product upwardly through the aperture while preventing removal of the center feed roll product downwardly therethrough and allowing dispensing of a discrete length of material from the center feed roll product downwardly therethrough, the securing means further adapted to support the center feed roll product thereon during dispensing; and a roll platform for retaining the securing means; and a cover adapted to mount to the base and defining a cavity within which the center feed roll product is contained for dispensing.

2. The roll dispenser of claim 1 further comprising a mounting member coupled to the roll platform.

3. The roll dispenser of claim 2, wherein the securing means comprises a hinge which pivots inward into the cavity permitting placement of the roll product within the dispenser and returns to a dispensing position to support the roll product for dispensing.

4. The roll dispenser of claim 3, wherein the securing means further comprises at least one buttress coupled to the hinge to prevent the hinge from pivoting past the dispensing position.

5. The roll dispenser of claim 1, further comprising a supporting means for supporting the securing means.

6. The roll dispenser of claim 5, wherein the supporting means comprises a movable flap attached to the base, the movable flap having an aperture therethrough for selectively positioning proximate to the securing means, the aperture in the movable flap aligning with the aperture in the securing means to enable dispensing of the center feed roll product.

7. The roll dispenser of claim 1, further comprising a door joined to the base by a living hinge, the door having an aperture therethrough.

8. The roll dispenser of claim 7, wherein the door comprises:

a sealing member attached to the door; and a latching assembly for securely latching the door in a closed position to the base.

9. The roll dispenser of claim 8, wherein the sealing member is positionable to substantially seal the door aperture for preventing liquids from entering the dispenser.

10. The roll dispenser of claim 1, further comprising a door coupled to the base and having an aperture therethrough.

11. The roll dispenser of claim 10, wherein the door further comprises:

a supporting means for contacting and supporting the securing means;

an aperture disc coupled to the door and surrounding the door aperture to aid the tearing of roll products; and a sealing member.

12. The roll dispenser of claim 11, further comprising a latching assembly for latching the door in a closed position with respect to the base.

13. The roll dispenser of claim 11 wherein the aperture disc is constructed from an elastomeric material.

14. The roll dispenser of claim 10 wherein the door further comprises:

a supporting means attached to the door wherein the supporting means further comprises a first protruding member extending in a first direction; and a second protruding member attached to the door and positioned in the aperture of the door and extending in a second direction substantially opposite the first direction whereby a roll product withdrawn from the dispenser is caused to follow a serpentine path around the first and second protruding members.

15. The roll dispenser of claim 1 wherein the cover is constructed from an opaque material having a window for viewing the roll product within.

16. The roll dispenser of claim 1 wherein the cover is constructed from a semi-transparent material for viewing the roll product within.

17. A dispenser for center feed roll products, the dispenser comprising:

a base further comprising a mounting member, a roll platform, and a securing means defining an aperture wherein the mounting member and the securing means are coupled to the roll platform permitting installation of a new fully wound center feed roll product upwardly through the aperture while preventing removal of the center feed roll product downwardly therethrough and allowing dispensing of a discrete length of material from the center feed roll product downwardly therethrough, the securing means further supporting the center feed roll product thereon during dispensing;

a cover adapted to mount to the base thereby defining a cavity within which the center feed roll product is contained for dispensing, wherein the cover is constructed from a semi-transparent material for viewing the roll product therein;

a door attached to the base, having an aperture therethrough, the door further comprising:

a supporting means having a first protruding member extending in a first direction; and a second protruding member attached to the door and positioned in the aperture extending in a second direction substantially opposite the first direction whereby a center feed roll product withdrawn from the dispenser is caused to follow a serpentine path around the first and second protruding members; and a latching assembly for latching the door in a closed position with respect to the base.

18. The dispenser of claim 17 wherein the securing means further comprises a plurality of cantilevered hinges each hinge attached at a first end to a portion of the securing means and extending radially inward toward the center of the securing means, wherein said hinges respectively have a plurality of hinge second ends, each second end opposite the respective first end defines the aperture.

19. The dispenser for center feed roll products of claim 17, wherein the roll product has a width from about 180 millimeters to about 245 millimeters.

20. A dispenser for center feed roll products, the dispenser comprising:

a base, the base comprising a securing means defining an aperture, the securing means adapted to permit installation of a new fully wound center feed roll product upwardly through the aperture while preventing removal of the center feed roll product downwardly therethrough and allowing dispensing of a discrete length of material from the center feed roll product downwardly therethrough, the securing means further supporting the center feed roll product thereon during dispensing; and a cover fastened to the base and defining a cavity within which the center feed roll product is contained for dispensing.

21. The dispenser of claim 20 wherein the securing means further comprises a plurality of cantilevered hinges each hinge attached at a first end to a portion of the securing means and extending radially inward toward the center of the securing means, wherein said hinges respectively have a plurality of hinge second ends, each second end opposite the respective first end defines the aperture.

22. The dispenser of claim 21 wherein the hinges pivot inward from a first position toward the cavity enabling placement of the center feed roll product therein, whereupon the hinges return to the first position to support the weight of the center feed roll product thereon.

23. The dispenser of claim 22 further comprising a door having an aperture therethrough, the door being fastened to the base, the aperture in the door aligning with the aperture formed by the cantilevered hinges to enable dispensing of a length of the center feed roll product.

24. The dispenser of claim 23 wherein the door further comprises a hinge support for contacting and supporting the plurality of cantilevered hinges.

25. The dispenser of claim 24 further comprising a positionable sealing member for selectively sealing the aperture in the door from liquid intrusion or enabling dispensing of the length of the center feed roll product.

26. The dispenser of claim 20 wherein at least a portion of the securing means pivots inward from a first position toward the cavity enabling placement of the center feed roll product therein, whereupon the portion of the securing means returns to the first position to support the weight of the center feed roll product thereon.

27. The dispenser of claim 26 further comprising a door having an aperture therethrough, the door being fastened to the base, the aperture in the door aligning with the aperture in the securing means to enable dispensing of the center feed roll product.

28. The dispenser of claim 27 further comprising a positionable sealing member for selectively sealing the aperture in the door from liquid intrusion or enabling dispensing of the length of the center feed roll product.

* * * * *